US010221506B2

(12) United States Patent
Yenici et al.

(10) Patent No.: US 10,221,506 B2
(45) Date of Patent: Mar. 5, 2019

(54) METHOD OF MAKING WOVEN FABRIC THAT PERFORMS LIKE A KNITTED FABRIC

(75) Inventors: Hamit Yenici, Inegol (TR); Fatima Korkmaz, Inegol (TR); Ertug Erkus, Inegol (TR); Ahmet Udul, Inegol (TR)

(73) Assignee: SANKO TEKSTIL ISLETMELERI SAN. VE TIC. A.S., Ingeol Busa (TR)

( * ) Notice: Subject to any disclaimer, the term of this patent is extended or adjusted under 35 U.S.C. 154(b) by 352 days.

(21) Appl. No.: 12/778,547

(22) Filed: May 12, 2010

(65) Prior Publication Data

US 2011/0212659 A1 Sep. 1, 2011

Related U.S. Application Data

(60) Provisional application No. 61/308,724, filed on Feb. 26, 2010.

(51) Int. Cl.
*D03D 15/08* (2006.01)
*D03D 41/00* (2006.01)
(Continued)

(52) U.S. Cl.
CPC ..... *D03D 15/04* (2013.01); *D03D 15/08* (2013.01); *D03D 17/00* (2013.01); *D03D 27/04* (2013.01); *Y10T 442/3024* (2015.04)

(58) Field of Classification Search
None
See application file for complete search history.

(56) References Cited

U.S. PATENT DOCUMENTS 1,672,186 A 3/1925 Wilson
1,965,248 A 6/1931 Moore
(Continued)

FOREIGN PATENT DOCUMENTS

CH 344686 A 2/1960
CN 2091299 U 12/1991
(Continued)

OTHER PUBLICATIONS

Cay et al.; Effects of Warp-Weft Density Variation and Fabric Porosity of the Cotton Fabrics on their Colour in Reactive Dyeing; Fibres & Textiles, Jan./Mar. 2007, vol. 15, No. 1 (60), pp. 91-94.*
(Continued)

*Primary Examiner* — Shawn Mckinnon
(74) *Attorney, Agent, or Firm* — Sughrue Mion, PLLC

(57) ABSTRACT

A fabric with wefts that include hard yarns and elastomeric yarns in a predetermined arrangement such that at least one hard yarn is alternately arranged with at least one elastomeric yarn, the elastomeric yarns having a greater shrinkage ratio than that of the hard yarns; the hard yarns form under portions and over portions with respect to warps, said under portions being formed when said hard yarns pass along the back side of the warps and defining loop portions, and said over portions being formed when the hard yarns pass along the front side of the warps and define connection portions, wherein for each hard yarn, an average number of warps passed by the loop portion is at least 6, and wherein the elastomeric yarns form under portions and over portions with respect to said warps in a weave that is tighter than the weave of the hard yarns.

42 Claims, 15 Drawing Sheets

(51) Int. Cl.

| | |
|---|---|
| ***D03D 15/04*** | (2006.01) |
| ***D03D 17/00*** | (2006.01) |
| ***D03D 27/04*** | (2006.01) |

(56) References Cited

U.S. PATENT DOCUMENTS

| | | | | |
|---|---|---|---|---|
| 2,330,645 | A | 9/1939 | Voegeli | |
| 2,254,339 | A | 9/1941 | Wylde et al. | |
| 2,268,809 | A | 1/1942 | De Roon | |
| 2,597,580 | A * | 5/1952 | Gluck | 139/392 |
| 2,809,673 | A | 7/1956 | McMurray | |
| 2,810,281 | A * | 10/1957 | Appleton et al. | 66/202 |
| 3,479,245 | A | 11/1969 | Manock | |
| 4,234,022 | A | 11/1980 | Okamoto et al. | |
| 4,283,194 | A * | 8/1981 | Teague et al. | 8/494 |
| 4,676,278 | A | 6/1987 | Dutt | |
| 4,714,096 | A | 12/1987 | Guay | |
| 4,739,803 | A | 4/1988 | Borel | |
| 4,892,539 | A | 1/1990 | Koch | |
| 5,054,524 | A | 10/1991 | Kato et al. | |
| 5,067,400 | A | 11/1991 | Bezella et al. | |
| 5,645,924 | A | 7/1997 | Hamilton | |
| 5,749,400 | A | 5/1998 | Pascual | |
| 5,837,622 | A | 11/1998 | Hamilton et al. | |
| 5,858,885 | A | 1/1999 | Hamilton et al. | |
| 6,666,235 | B2 | 12/2003 | Chi et al. | |
| 6,752,840 | B1 | 6/2004 | Onishi et al. | |
| 6,918,413 | B2 | 7/2005 | Ono et al. | |
| 7,299,828 | B2 | 11/2007 | Liao | |
| 7,310,932 | B2 * | 12/2007 | Liao | 57/210 |
| 2006/0179810 | A1 | 8/2006 | Liao | |
| 2008/0096001 | A1 * | 4/2008 | Emden | A41D 31/02 428/222 |
| 2008/0268734 | A1 | 10/2008 | Tharpe et al. | |
| 2009/0126057 | A1 * | 5/2009 | Rock | A41D 27/28 2/2.5 |
| 2009/0191777 | A1 | 7/2009 | Liao | |
| 2010/0093258 | A1 * | 4/2010 | Glenn et al. | 450/86 |
| 2010/0248574 | A1 | 9/2010 | King et al. | |
| 2015/0159320 | A1 | 6/2015 | Lau | |

FOREIGN PATENT DOCUMENTS

| | | | |
|---|---|---|---|
| CN | 101328635 | A | 12/2008 |
| DE | 1757093 | U | 11/1957 |
| DE | 7013604 | U | 7/1970 |
| DE | 3247651 | A1 | 8/1984 |
| DE | 68911941 | T2 | 5/1994 |
| DE | 4444825 | A1 | 6/1995 |
| EP | 0327903 | A2 | 8/1989 |
| EP | 1676944 | A1 | 7/2006 |
| EP | 2019159 | A1 | 1/2009 |
| GB | 308849 | | 4/1929 |
| GB | 409273 | A | 4/1934 |
| GB | 512578 | A | 9/1939 |
| JP | S61282453 | A | 12/1986 |
| JP | H11181649 | A | 7/1999 |
| JP | 2001295152 | A | 10/2001 |
| JP | 2002302845 | A | 10/2002 |
| JP | 3104242 | U | 9/2004 |
| JP | 2005179796 | * | 7/2005 |
| JP | 2009-97107 | A | 5/2009 |
| JP | 2011-511888 | A | 4/2011 |
| WO | 2004/099478 | A1 | 11/2004 |
| WO | 2007118672 | A1 | 10/2007 |

OTHER PUBLICATIONS

Translation of DE 3247651, Tenge, Aug. 24, 1984.*
Machine translation of JP2005179796, Seki et al, Jul. 2005.*
ACP composites, http://www.acpsales.com/Woven-Fabric-Style-Guide.html, visited page on Aug. 15, 2016.*
Japanese Office Action dated Mar. 28, 2014 issued in corresponding Japanese Patent Application No. 2012-554247.
Third Party Submission in U.S. Appl. No. 13/580,172, filed Apr. 11, 2014.
Notice of Opposition to a European Patent dated Nov. 5, 2015 in counterpart application No. 11706485.7.
Specification sheet of FAENZA fabric of Nov. 7, 2007 (2 pages).
Specification sheet of arrangement of warping and weaving of FAENZA fabric of Nov. 27, 2007 (1 page).
E-mail correspondence between LAN. EUROPA and LINSET TEKSTIL of Sep.-Oct. 3, 2008 (1 page).
E-mail correspondence between LAN. EUROPA and LINSET TEKSTIL of Mar. 12, 2008 (1 page).
Order proposal No. 10347 by LAN. EUROPAto LINSET TEKSIL regarding FAENZA fabric and others of Mar. 14, 2008 (1 page).
Specification sheet of FEP/PL fabric of Jul. 16, 2007 (3 pages).
Specification sheet of arrangement of warp and weft of FEP/PL fabric of Nov. 6, 2007 (1 page).
Written declaration of the facts signed by Luigi Guarducci, chairman and CEO of LAN. EUROPA (1 page).
Book. "Large Book of textile designs" Franz Donat, 1895 (5 pages).
Book: "Tessuti a licci", Giacomo Airoldi, 1981 (3 pages).
Book: "Il tessuto ordito e trama ad intreccio ortogonale", Giacomo Airoldi, 2000 (4 pages).
Book: "Tecnologia Tessile—Fibre—Filati—Tessuti", Giorgio Moreschi, 1968 (6 pages).
Pile Weaves, International Textbook Co., 1905, 36 pages.
Notice of Opposition against EP 2539493, Wolfgang Mordhorst, Feb. 22, 2016.
Intervention in Opposition against EP 253493, Peek et al., Dec. 9, 2016.
Intervention in Opposition against EP 253949361, BRAX Store GmbH, et al., Sep. 21, 2016.
Notice of Opposition against EP 20110706485, S. Mensucat, Feb. 19, 2016.
Intervention in Opposition against EP 2539493, Calik Denim Tekstil San. ve Tic. A.S., Jun. 9, 2016.
Intervention in Opposition against EP 2539493, Abercrombie & Fitch Stores, Inc., Nov. 8, 2016.
Intervention in Opposition against EP 2539493 B1, Adidas AG, Jun. 23, 2016.
Communication dated Jul. 6, 2018 from the State Intellectual Property Office of the P.R.C. in counterpart Application No. 201611241947.7.
Communication dated Jul. 20, 2018 from the State Intellectual Property Office of the P.R.C. in counterpart Application No. 201611241942.4.
Communication dated Sep. 3, 2018, issued by the State Intellectual Property Office of the P.R.C. in corresponding Chinese Application No. 201610094576.8.

* cited by examiner

FIG. 5

| | | | | | | | | | | | | | | |
|---|---|---|---|---|---|---|---|---|---|---|---|---|---|---|
| PICK 36 | ■ | ■ | | ■ | ■ | | ■ | ■ | | ■ | ■ | | 1 | 70 DEN pes lycra |
| PICK 35 | ■ | ■ | ■ | ■ | ■ | ■ | ■ | ■ | | ■ | ■ | ■ | 2 | NE 50/1 COTTON |
| PICK 34 | ■ | ■ | ■ | ■ | ■ | ■ | ■ | ■ | | ■ | ■ | ■ | 3 | NE 50/1 COTTON |
| PICK 33 | ■ | | ■ | ■ | | ■ | ■ | | ■ | ■ | | ■ | 1 | 70 DEN pes lycra |
| PICK 32 | ■ | | ■ | ■ | ■ | ■ | ■ | ■ | ■ | ■ | ■ | ■ | 2 | NE 50/1 COTTON |
| PICK 31 | ■ | | ■ | ■ | ■ | ■ | ■ | ■ | ■ | ■ | ■ | ■ | 3 | NE 50/1 COTTON |
| PICK 30 | | ■ | ■ | | ■ | ■ | | ■ | ■ | | ■ | ■ | 1 | 70 DEN pes lycra |
| PICK 29 | ■ | ■ | ■ | ■ | ■ | ■ | | ■ | ■ | ■ | ■ | ■ | 2 | NE 50/1 COTTON |
| PICK 28 | ■ | ■ | ■ | ■ | ■ | ■ | | ■ | ■ | ■ | ■ | ■ | 3 | NE 50/1 COTTON |
| PICK 27 | ■ | ■ | | ■ | ■ | | ■ | ■ | | ■ | ■ | | 1 | 70 DEN pes lycra |
| PICK 26 | ■ | ■ | ■ | ■ | ■ | ■ | ■ | ■ | ■ | ■ | ■ | | 2 | NE 50/1 COTTON |
| PICK 25 | ■ | ■ | ■ | ■ | ■ | ■ | ■ | ■ | ■ | ■ | ■ | | 3 | NE 50/1 COTTON |
| PICK 24 | ■ | | ■ | ■ | | ■ | ■ | | ■ | ■ | | ■ | 1 | 70 DEN pes lycra |
| PICK 23 | ■ | ■ | ■ | ■ | | ■ | ■ | ■ | ■ | ■ | ■ | ■ | 2 | NE 50/1 COTTON |
| PICK 22 | ■ | ■ | ■ | ■ | | ■ | ■ | ■ | ■ | ■ | ■ | ■ | 3 | NE 50/1 COTTON |
| PICK 21 | | ■ | ■ | | ■ | ■ | | ■ | ■ | | ■ | ■ | 1 | 70 DEN pes lycra |
| PICK 20 | ■ | ■ | ■ | ■ | ■ | ■ | ■ | ■ | ■ | | ■ | ■ | 2 | NE 50/1 COTTON |
| PICK 19 | ■ | ■ | ■ | ■ | ■ | ■ | ■ | ■ | ■ | | ■ | ■ | 3 | NE 50/1 COTTON |
| PICK 18 | ■ | ■ | | ■ | ■ | | ■ | ■ | | ■ | ■ | | 1 | 70 DEN pes lycra |
| PICK 17 | ■ | ■ | | ■ | ■ | ■ | ■ | ■ | ■ | ■ | ■ | ■ | 2 | NE 50/1 COTTON |
| PICK 16 | ■ | ■ | | ■ | ■ | ■ | ■ | ■ | ■ | ■ | ■ | ■ | 3 | NE 50/1 COTTON |
| PICK 15 | ■ | | ■ | ■ | | ■ | ■ | | ■ | ■ | | ■ | 1 | 70 DEN pes lycra |
| PICK 14 | ■ | ■ | ■ | ■ | ■ | ■ | ■ | | ■ | ■ | ■ | ■ | 2 | NE 50/1 COTTON |
| PICK 13 | ■ | ■ | ■ | ■ | ■ | ■ | ■ | | ■ | ■ | ■ | ■ | 3 | NE 50/1 COTTON |
| PICK 12 | | ■ | ■ | | ■ | ■ | | ■ | ■ | | ■ | ■ | 1 | 70 DEN pes lycra |
| PICK 11 | | ■ | ■ | ■ | ■ | ■ | ■ | ■ | ■ | ■ | ■ | ■ | 2 | NE 50/1 COTTON |
| PICK 10 | | ■ | ■ | ■ | ■ | ■ | ■ | ■ | ■ | ■ | ■ | ■ | 3 | NE 50/1 COTTON |
| PICK 9 | ■ | ■ | | ■ | ■ | | ■ | ■ | | ■ | ■ | | 1 | 70 DEN pes lycra |
| PICK 8 | ■ | ■ | ■ | ■ | ■ | | ■ | ■ | ■ | ■ | ■ | ■ | 2 | NE 50/1 COTTON |
| PICK 7 | ■ | ■ | ■ | ■ | ■ | | ■ | ■ | ■ | ■ | ■ | ■ | 3 | NE 50/1 COTTON |
| PICK 6 | ■ | | ■ | ■ | | ■ | ■ | | ■ | ■ | | ■ | 1 | 70 DEN pes lycra |
| PICK 5 | ■ | ■ | ■ | ■ | ■ | ■ | ■ | ■ | ■ | ■ | | ■ | 2 | NE 50/1 COTTON |
| PICK 4 | ■ | ■ | ■ | ■ | ■ | ■ | ■ | ■ | ■ | ■ | | ■ | 3 | NE 50/1 COTTON |
| PICK 3 | | ■ | ■ | | ■ | ■ | | ■ | ■ | | ■ | ■ | 1 | 70 DEN pes lycra |
| PICK 2 | ■ | ■ | ■ | | ■ | ■ | ■ | ■ | ■ | ■ | ■ | ■ | 2 | NE 50/1 COTTON |
| PICK 1 | ■ | ■ | ■ | | ■ | ■ | ■ | ■ | ■ | ■ | ■ | ■ | 3 | NE 50/1 COTTON |
| | W1 | W2 | W3 | W4 | W5 | W6 | W7 | W8 | W9 | W10 | W11 | W12 | | |

FIG. 6

| | | | | | | | | | | | | | | | |
|---|---|---|---|---|---|---|---|---|---|---|---|---|---|---|---|
| PICK 36 | 1 | ■ | | ■ | ■ | | ■ | ■ | | ■ | ■ | | ■ | 1 | 70 DEN pes lycra |
| PICK 35 | 2 | | ■ | ■ | | ■ | ■ | | ■ | ■ | | ■ | ■ | 1 | 70 DEN pes lycra |
| PICK 34 | 3 | ■ | ■ | ■ | | ■ | ■ | ■ | ■ | ■ | ■ | ■ | ■ | 2 | 50/1 NE COTTON |
| PICK 33 | 1 | ■ | ■ | | ■ | ■ | | ■ | ■ | | ■ | ■ | | 1 | 70 DEN pes lycra |
| PICK 32 | 2 | ■ | | ■ | ■ | | ■ | ■ | | ■ | ■ | | ■ | 1 | 70 DEN pes lycra |
| PICK 31 | 3 | ■ | ■ | ■ | ■ | ■ | ■ | ■ | ■ | ■ | ■ | | ■ | 2 | 50/1 NE COTTON |
| PICK 30 | 1 | | ■ | ■ | | ■ | ■ | | ■ | ■ | | ■ | ■ | 1 | 70 DEN pes lycra |
| PICK 29 | 2 | ■ | ■ | | ■ | ■ | | ■ | ■ | | ■ | ■ | | 1 | 70 DEN pes lycra |
| PICK 28 | 3 | ■ | ■ | ■ | ■ | ■ | | ■ | ■ | ■ | ■ | ■ | ■ | 2 | 50/1 NE COTTON |
| PICK 27 | 1 | ■ | | ■ | ■ | | ■ | ■ | | ■ | ■ | | ■ | 1 | 70 DEN pes lycra |
| PICK 26 | 2 | | ■ | ■ | | ■ | ■ | | ■ | ■ | | ■ | ■ | 1 | 70 DEN pes lycra |
| PICK 25 | 3 | | ■ | ■ | ■ | ■ | ■ | ■ | ■ | ■ | ■ | ■ | ■ | 2 | 50/1 NE COTTON |
| PICK 24 | 1 | ■ | ■ | | ■ | ■ | | ■ | ■ | | ■ | ■ | | 1 | 70 DEN pes lycra |
| PICK 23 | 2 | ■ | | ■ | ■ | | ■ | ■ | | ■ | ■ | | ■ | 1 | 70 DEN pes lycra |
| PICK 22 | 3 | ■ | ■ | ■ | ■ | ■ | ■ | ■ | | ■ | ■ | ■ | ■ | 2 | 50/1 NE COTTON |
| PICK 21 | 1 | | ■ | ■ | | ■ | ■ | | ■ | ■ | | ■ | ■ | 1 | 70 DEN pes lycra |
| PICK 20 | 2 | ■ | ■ | | ■ | ■ | | ■ | ■ | | ■ | ■ | | 1 | 70 DEN pes lycra |
| PICK 19 | 3 | ■ | ■ | | ■ | ■ | ■ | ■ | ■ | ■ | ■ | ■ | ■ | 2 | 50/1 NE COTTON |
| PICK 18 | 1 | ■ | | ■ | ■ | | ■ | ■ | | ■ | ■ | | ■ | 1 | 70 DEN pes lycra |
| PICK 17 | 2 | | ■ | ■ | | ■ | ■ | | ■ | ■ | | ■ | ■ | 1 | 70 DEN pes lycra |
| PICK 16 | 3 | ■ | ■ | ■ | ■ | ■ | ■ | ■ | ■ | ■ | | ■ | ■ | 2 | 50/1 NE COTTON |
| PICK 15 | 1 | ■ | ■ | | ■ | ■ | | ■ | ■ | | ■ | ■ | | 1 | 70 DEN pes lycra |
| PICK 14 | 2 | ■ | | ■ | ■ | | ■ | ■ | | ■ | ■ | | ■ | 1 | 70 DEN pes lycra |
| PICK 13 | 3 | ■ | ■ | ■ | ■ | | ■ | ■ | ■ | ■ | ■ | ■ | ■ | 2 | 50/1 NE COTTON |
| PICK 12 | 1 | | ■ | ■ | | ■ | ■ | | ■ | ■ | | ■ | ■ | 1 | 70 DEN pes lycra |
| PICK 11 | 2 | ■ | ■ | | ■ | ■ | | ■ | ■ | | ■ | ■ | | 1 | 70 DEN pes lycra |
| PICK 10 | 3 | ■ | ■ | ■ | ■ | ■ | ■ | ■ | ■ | ■ | ■ | ■ | | 2 | 50/1 NE COTTON |
| PICK 9 | 1 | ■ | | ■ | ■ | | ■ | ■ | | ■ | ■ | | ■ | 1 | 70 DEN pes lycra |
| PICK 8 | 2 | | ■ | ■ | | ■ | ■ | | ■ | ■ | | ■ | ■ | 1 | 70 DEN pes lycra |
| PICK 7 | 3 | ■ | ■ | ■ | ■ | ■ | ■ | | ■ | ■ | ■ | ■ | ■ | 2 | 50/1 NE COTTON |
| PICK 6 | 1 | ■ | ■ | | ■ | ■ | | ■ | ■ | | ■ | ■ | | 1 | 70 DEN pes lycra |
| PICK 5 | 2 | ■ | | ■ | ■ | | ■ | ■ | | ■ | ■ | | ■ | 1 | 70 DEN pes lycra |
| PICK 4 | 3 | ■ | | ■ | ■ | ■ | ■ | ■ | ■ | ■ | ■ | ■ | ■ | 2 | 50/1 NE COTTON |
| PICK 3 | 1 | | ■ | ■ | | ■ | ■ | | ■ | ■ | | ■ | ■ | 1 | 70 DEN pes lycra |
| PICK 2 | 2 | ■ | ■ | | ■ | ■ | | ■ | ■ | | ■ | ■ | | 1 | 70 DEN pes lycra |
| PICK 1 | 3 | ■ | ■ | ■ | ■ | ■ | ■ | ■ | ■ | | ■ | ■ | ■ | 2 | 50/1 NE COTTON |
| | | W1 | W2 | W3 | W4 | W5 | W6 | W7 | W8 | W9 | W10 | W11 | W12 | | |

FIG. 9

| | | | | | | | | | | | | | | | |
|---|---|---|---|---|---|---|---|---|---|---|---|---|---|---|---|
| PICK 24 | 2 | | ■ | ■ | ■ | | ■ | ■ | ■ | | ■ | ■ | ■ | 1 | 70 DEN pes lycra |
| PICK 23 | 3 | ■ | ■ | ■ | ■ | ■ | ■ | ■ | ■ | | ■ | ■ | ■ | 2 | NE 50/1 COTTON |
| PICK 22 | 2 | ■ | ■ | | ■ | ■ | ■ | | ■ | ■ | ■ | | ■ | 1 | 70 DEN pes lycra |
| PICK 21 | 3 | ■ | | ■ | ■ | ■ | ■ | ■ | ■ | ■ | ■ | ■ | ■ | 2 | NE 50/1 COTTON |
| PICK 20 | 2 | | ■ | ■ | ■ | | ■ | ■ | ■ | | ■ | ■ | ■ | 1 | 70 DEN pes lycra |
| PICK 19 | 3 | ■ | ■ | ■ | ■ | ■ | ■ | | ■ | ■ | ■ | ■ | ■ | 2 | NE 50/1 COTTON |
| PICK 18 | 2 | ■ | ■ | | ■ | ■ | ■ | | ■ | ■ | ■ | | ■ | 1 | 70 DEN pes lycra |
| PICK 17 | 3 | ■ | ■ | ■ | ■ | ■ | ■ | ■ | ■ | ■ | ■ | ■ | | 2 | NE 50/1 COTTON |
| PICK 16 | 2 | | ■ | ■ | ■ | | ■ | ■ | ■ | | ■ | ■ | ■ | 1 | 70 DEN pes lycra |
| PICK 15 | 3 | ■ | ■ | ■ | ■ | | ■ | ■ | ■ | ■ | ■ | ■ | ■ | 2 | NE 50/1 COTTON |
| PICK 14 | 2 | ■ | ■ | | ■ | ■ | ■ | | ■ | ■ | ■ | | ■ | 1 | 70 DEN pes lycra |
| PICK 13 | 3 | ■ | ■ | ■ | ■ | ■ | ■ | ■ | ■ | ■ | | ■ | ■ | 2 | NE 50/1 COTTON |
| PICK 12 | 2 | | ■ | ■ | ■ | | ■ | ■ | ■ | | ■ | ■ | ■ | 1 | 70 DEN pes lycra |
| PICK 11 | 3 | ■ | ■ | | ■ | ■ | ■ | ■ | ■ | ■ | ■ | ■ | ■ | 2 | NE 50/1 COTTON |
| PICK 10 | 2 | ■ | ■ | | ■ | ■ | ■ | | ■ | ■ | ■ | | ■ | 1 | 70 DEN pes lycra |
| PICK 9 | 3 | ■ | ■ | ■ | ■ | ■ | ■ | ■ | | ■ | ■ | ■ | ■ | 2 | NE 50/1 COTTON |
| PICK 8 | 2 | | ■ | ■ | ■ | | ■ | ■ | ■ | | ■ | ■ | ■ | 1 | 70 DEN pes lycra |
| PICK 7 | 3 | | ■ | ■ | ■ | ■ | ■ | ■ | ■ | ■ | ■ | ■ | ■ | 2 | NE 50/1 COTTON |
| PICK 6 | 2 | ■ | ■ | | ■ | ■ | ■ | | ■ | ■ | ■ | | ■ | 1 | 70 DEN pes lycra |
| PICK 5 | 3 | ■ | ■ | ■ | ■ | ■ | | ■ | ■ | ■ | ■ | ■ | ■ | 2 | NE 50/1 COTTON |
| PICK 4 | 2 | | ■ | ■ | ■ | | ■ | ■ | ■ | | ■ | ■ | ■ | 1 | 70 DEN pes lycra |
| PICK 3 | 3 | ■ | ■ | ■ | ■ | ■ | ■ | ■ | ■ | ■ | ■ | | ■ | 2 | NE 50/1 COTTON |
| PICK 2 | 2 | ■ | ■ | | ■ | ■ | ■ | | ■ | ■ | ■ | | ■ | 1 | 70 DEN pes lycra |
| PICK 1 | 3 | ■ | ■ | ■ | | ■ | ■ | ■ | ■ | ■ | ■ | ■ | ■ | 2 | NE 50/1 COTTON |
| | | W1 | W2 | W3 | W4 | W5 | W6 | W7 | W8 | W9 | W10 | W11 | W12 | | |

FIG. 11

| | | | | | | | | | | | | | | |
|---|---|---|---|---|---|---|---|---|---|---|---|---|---|---|
| PICK 36 | ■ | ■ | | ■ | ■ | | ■ | ■ | | ■ | ■ | | 1 | 70 DEN NYL (Without lycra) |
| PICK 35 | ■ | ■ | ■ | ■ | ■ | ■ | ■ | ■ | | ■ | ■ | ■ | 2 | NE 50/1 COTTON |
| PICK 34 | ■ | ■ | ■ | ■ | ■ | ■ | ■ | ■ | | ■ | ■ | ■ | 3 | NE 50/1 COTTON |
| PICK 33 | ■ | | ■ | ■ | | ■ | ■ | | ■ | ■ | | ■ | 1 | 70 DEN NYL (Without lycra) |
| PICK 32 | ■ | | ■ | ■ | ■ | ■ | ■ | ■ | ■ | ■ | ■ | ■ | 2 | NE 50/1 COTTON |
| PICK 31 | ■ | | ■ | ■ | ■ | ■ | ■ | ■ | ■ | ■ | ■ | ■ | 3 | NE 50/1 COTTON |
| PICK 30 | | ■ | ■ | | ■ | ■ | | ■ | ■ | | ■ | ■ | 1 | 70 DEN NYL (Without lycra) |
| PICK 29 | ■ | ■ | ■ | ■ | ■ | ■ | | ■ | ■ | ■ | ■ | ■ | 2 | NE 50/1 COTTON |
| PICK 28 | ■ | ■ | ■ | ■ | ■ | ■ | | ■ | ■ | ■ | ■ | ■ | 3 | NE 50/1 COTTON |
| PICK 27 | ■ | ■ | | ■ | ■ | | ■ | ■ | | ■ | ■ | | 1 | 70 DEN NYL (Without lycra) |
| PICK 26 | ■ | ■ | ■ | ■ | ■ | ■ | ■ | ■ | ■ | ■ | ■ | | 2 | NE 50/1 COTTON |
| PICK 25 | ■ | ■ | ■ | ■ | ■ | ■ | ■ | ■ | ■ | ■ | ■ | | 3 | NE 50/1 COTTON |
| PICK 24 | ■ | | ■ | ■ | | ■ | ■ | | ■ | ■ | | ■ | 1 | 70 DEN NYL (Without lycra) |
| PICK 23 | ■ | ■ | ■ | ■ | | ■ | ■ | ■ | ■ | ■ | ■ | ■ | 2 | NE 50/1 COTTON |
| PICK 22 | ■ | ■ | ■ | ■ | | ■ | ■ | ■ | ■ | ■ | ■ | ■ | 3 | NE 50/1 COTTON |
| PICK 21 | | ■ | ■ | | ■ | ■ | | ■ | ■ | | ■ | ■ | 1 | 70 DEN NYL (Without lycra) |
| PICK 20 | ■ | ■ | ■ | ■ | ■ | ■ | ■ | ■ | ■ | | ■ | ■ | 2 | NE 50/1 COTTON |
| PICK 19 | ■ | ■ | ■ | ■ | ■ | ■ | ■ | ■ | ■ | | ■ | ■ | 3 | NE 50/1 COTTON |
| PICK 18 | ■ | ■ | | ■ | ■ | | ■ | ■ | | ■ | ■ | | 1 | 70 DEN NYL (Without lycra) |
| PICK 17 | ■ | ■ | | ■ | ■ | ■ | ■ | ■ | ■ | ■ | ■ | ■ | 2 | NE 50/1 COTTON |
| PICK 16 | ■ | ■ | | ■ | ■ | ■ | ■ | ■ | ■ | ■ | ■ | ■ | 3 | NE 50/1 COTTON |
| PICK 15 | ■ | | ■ | ■ | | ■ | ■ | | ■ | ■ | | ■ | 1 | 70 DEN NYL (Without lycra) |
| PICK 14 | ■ | ■ | ■ | ■ | ■ | ■ | ■ | | ■ | ■ | ■ | ■ | 2 | NE 50/1 COTTON |
| PICK 13 | ■ | ■ | ■ | ■ | ■ | ■ | ■ | | ■ | ■ | ■ | ■ | 3 | NE 50/1 COTTON |
| PICK 12 | | ■ | ■ | | ■ | ■ | | ■ | ■ | | ■ | ■ | 1 | 70 DEN NYL (Without lycra) |
| PICK 11 | | ■ | ■ | ■ | ■ | ■ | ■ | ■ | ■ | ■ | ■ | ■ | 2 | NE 50/1 COTTON |
| PICK 10 | | ■ | ■ | ■ | ■ | ■ | ■ | ■ | ■ | ■ | ■ | ■ | 3 | NE 50/1 COTTON |
| PICK 9 | ■ | ■ | | ■ | ■ | | ■ | ■ | | ■ | ■ | | 1 | 70 DEN NYL (Without lycra) |
| PICK 8 | ■ | ■ | ■ | ■ | ■ | | ■ | ■ | ■ | ■ | ■ | ■ | 2 | NE 50/1 COTTON |
| PICK 7 | ■ | ■ | ■ | ■ | ■ | | ■ | ■ | ■ | ■ | ■ | ■ | 3 | NE 50/1 COTTON |
| PICK 6 | ■ | | ■ | ■ | | ■ | ■ | | ■ | ■ | | ■ | 1 | 70 DEN NYL (Without lycra) |
| PICK 5 | ■ | ■ | ■ | ■ | ■ | ■ | ■ | ■ | ■ | ■ | | ■ | 2 | NE 50/1 COTTON |
| PICK 4 | ■ | ■ | ■ | ■ | ■ | ■ | ■ | ■ | ■ | ■ | | ■ | 3 | NE 50/1 COTTON |
| PICK 3 | | ■ | ■ | | ■ | ■ | | ■ | ■ | | ■ | ■ | 1 | 70 DEN NYL (Without lycra) |
| PICK 2 | ■ | ■ | ■ | | ■ | ■ | ■ | ■ | ■ | ■ | ■ | ■ | 2 | NE 50/1 COTTON |
| PICK 1 | ■ | ■ | ■ | | ■ | ■ | ■ | ■ | ■ | ■ | ■ | ■ | 3 | NE 50/1 COTTON |
| | W1 | W2 | W3 | W4 | W5 | W6 | W7 | W8 | W9 | W10 | W11 | W12 | | |

FIG. 13

| | | | | | | | | | | | | | | |
|---|---|---|---|---|---|---|---|---|---|---|---|---|---|---|
| PICK 36 | ■ | ■ | | ■ | ■ | | ■ | ■ | | ■ | ■ | | 1 | 70 DEN pes lycra |
| PICK 35 | ■ | ■ | ■ | ■ | ■ | ■ | ■ | ■ | | ■ | ■ | ■ | 2 | 150 DEN micro pes |
| PICK 34 | ■ | ■ | ■ | ■ | ■ | ■ | ■ | ■ | | ■ | ■ | ■ | 3 | 150 DEN micro pes |
| PICK 33 | ■ | | ■ | ■ | | ■ | ■ | | ■ | ■ | | ■ | 1 | 70 DEN pes lycra |
| PICK 32 | ■ | | ■ | ■ | ■ | ■ | ■ | ■ | ■ | ■ | ■ | ■ | 2 | 150 DEN micro pes |
| PICK 31 | ■ | | ■ | ■ | ■ | ■ | ■ | ■ | ■ | ■ | ■ | ■ | 3 | 150 DEN micro pes |
| PICK 30 | | ■ | ■ | | ■ | ■ | | ■ | ■ | | ■ | ■ | 1 | 70 DEN pes lycra |
| PICK 29 | ■ | ■ | ■ | ■ | ■ | ■ | | ■ | ■ | ■ | ■ | ■ | 2 | 150 DEN micro pes |
| PICK 28 | ■ | ■ | ■ | ■ | ■ | ■ | | ■ | ■ | ■ | ■ | ■ | 3 | 150 DEN micro pes |
| PICK 27 | ■ | ■ | | ■ | ■ | | ■ | ■ | | ■ | ■ | | 1 | 70 DEN pes lycra |
| PICK 26 | ■ | ■ | ■ | ■ | ■ | ■ | ■ | ■ | ■ | ■ | ■ | | 2 | 150 DEN micro pes |
| PICK 25 | ■ | ■ | ■ | ■ | ■ | ■ | ■ | ■ | ■ | ■ | ■ | | 3 | 150 DEN micro pes |
| PICK 24 | ■ | | ■ | ■ | | ■ | ■ | | ■ | ■ | | ■ | 1 | 70 DEN pes lycra |
| PICK 23 | ■ | ■ | ■ | ■ | | ■ | ■ | ■ | ■ | ■ | ■ | ■ | 2 | 150 DEN micro pes |
| PICK 22 | ■ | ■ | ■ | ■ | | ■ | ■ | ■ | ■ | ■ | ■ | ■ | 3 | 150 DEN micro pes |
| PICK 21 | | ■ | ■ | | ■ | ■ | | ■ | ■ | | ■ | ■ | 1 | 70 DEN pes lycra |
| PICK 20 | ■ | ■ | ■ | ■ | ■ | ■ | ■ | ■ | ■ | | ■ | ■ | 2 | 150 DEN micro pes |
| PICK 19 | ■ | ■ | ■ | ■ | ■ | ■ | ■ | ■ | ■ | | ■ | ■ | 3 | 150 DEN micro pes |
| PICK 18 | ■ | ■ | | ■ | ■ | | ■ | ■ | | ■ | ■ | | 1 | 70 DEN pes lycra |
| PICK 17 | ■ | ■ | | ■ | ■ | ■ | ■ | ■ | ■ | ■ | ■ | ■ | 2 | 150 DEN micro pes |
| PICK 16 | ■ | ■ | | ■ | ■ | ■ | ■ | ■ | ■ | ■ | ■ | ■ | 3 | 150 DEN micro pes |
| PICK 15 | ■ | | ■ | ■ | | ■ | ■ | | ■ | ■ | | ■ | 1 | 70 DEN pes lycra |
| PICK 14 | ■ | ■ | ■ | ■ | ■ | ■ | ■ | | ■ | ■ | ■ | ■ | 2 | 150 DEN micro pes |
| PICK 13 | ■ | ■ | ■ | ■ | ■ | ■ | ■ | | ■ | ■ | ■ | ■ | 3 | 150 DEN micro pes |
| PICK 12 | | ■ | ■ | | ■ | ■ | | ■ | ■ | | ■ | ■ | 1 | 70 DEN pes lycra |
| PICK 11 | | ■ | ■ | ■ | ■ | ■ | ■ | ■ | ■ | ■ | ■ | ■ | 2 | 150 DEN micro pes |
| PICK 10 | | ■ | ■ | ■ | ■ | ■ | ■ | ■ | ■ | ■ | ■ | ■ | 3 | 150 DEN micro pes |
| PICK 9 | ■ | ■ | | ■ | ■ | | ■ | ■ | | ■ | ■ | | 1 | 70 DEN pes lycra |
| PICK 8 | ■ | ■ | ■ | ■ | ■ | | ■ | ■ | ■ | ■ | ■ | ■ | 2 | 150 DEN micro pes |
| PICK 7 | ■ | ■ | ■ | ■ | ■ | | ■ | ■ | ■ | ■ | ■ | ■ | 3 | 150 DEN micro pes |
| PICK 6 | ■ | | ■ | ■ | | ■ | ■ | | ■ | ■ | | ■ | 1 | 70 DEN pes lycra |
| PICK 5 | ■ | ■ | ■ | ■ | ■ | ■ | ■ | ■ | ■ | ■ | | ■ | 2 | 150 DEN micro pes |
| PICK 4 | ■ | ■ | ■ | ■ | ■ | ■ | ■ | ■ | ■ | ■ | | ■ | 3 | 150 DEN micro pes |
| PICK 3 | | ■ | ■ | | ■ | ■ | | ■ | ■ | | ■ | ■ | 1 | 70 DEN pes lycra |
| PICK 2 | ■ | ■ | ■ | | ■ | ■ | ■ | ■ | ■ | ■ | ■ | ■ | 2 | 150 DEN micro pes |
| PICK 1 | ■ | ■ | ■ | | ■ | ■ | ■ | ■ | ■ | ■ | ■ | ■ | 3 | 150 DEN micro pes |
| | W1 | W2 | W3 | W4 | W5 | W6 | W7 | W8 | W9 | W10 | W11 | W12 | | |

FIG. 14

| | | | | | | | | | | | | | | |
|---|---|---|---|---|---|---|---|---|---|---|---|---|---|---|
| PICK 36 | ■ | ■ | | ■ | ■ | | ■ | ■ | | ■ | ■ | | 1 | 70 DEN pes lycra |
| PICK 35 | ■ | ■ | ■ | ■ | ■ | ■ | ■ | ■ | | ■ | ■ | ■ | 2 | NE 16/1 COTTON |
| PICK 34 | ■ | ■ | ■ | ■ | ■ | ■ | ■ | ■ | | ■ | ■ | ■ | 3 | NE 16/1 COTTON |
| PICK 33 | ■ | | ■ | ■ | | ■ | ■ | | ■ | ■ | | ■ | 1 | 70 DEN pes lycra |
| PICK 32 | ■ | | ■ | ■ | ■ | ■ | ■ | ■ | ■ | ■ | ■ | ■ | 2 | NE 16/1 COTTON |
| PICK 31 | ■ | | ■ | ■ | ■ | ■ | ■ | ■ | ■ | ■ | ■ | ■ | 3 | NE 16/1 COTTON |
| PICK 30 | | ■ | ■ | | ■ | ■ | | ■ | ■ | | ■ | ■ | 1 | 70 DEN pes lycra |
| PICK 29 | ■ | ■ | ■ | ■ | ■ | ■ | | ■ | ■ | ■ | ■ | ■ | 2 | NE 16/1 COTTON |
| PICK 28 | ■ | ■ | ■ | ■ | ■ | ■ | | ■ | ■ | ■ | ■ | ■ | 3 | NE 16/1 COTTON |
| PICK 27 | ■ | ■ | | ■ | ■ | | ■ | ■ | | ■ | ■ | | 1 | 70 DEN pes lycra |
| PICK 26 | ■ | ■ | ■ | ■ | ■ | ■ | ■ | ■ | ■ | ■ | ■ | | 2 | NE 16/1 COTTON |
| PICK 25 | ■ | ■ | ■ | ■ | ■ | ■ | ■ | ■ | ■ | ■ | ■ | | 3 | NE 16/1 COTTON |
| PICK 24 | ■ | | ■ | ■ | | ■ | ■ | | ■ | ■ | | ■ | 1 | 70 DEN pes lycra |
| PICK 23 | ■ | ■ | ■ | ■ | | ■ | ■ | ■ | ■ | ■ | ■ | ■ | 2 | NE 16/1 COTTON |
| PICK 22 | ■ | ■ | ■ | ■ | | ■ | ■ | ■ | ■ | ■ | ■ | ■ | 3 | NE 16/1 COTTON |
| PICK 21 | | ■ | ■ | | ■ | ■ | | ■ | ■ | | ■ | ■ | 1 | 70 DEN pes lycra |
| PICK 20 | ■ | ■ | ■ | ■ | ■ | ■ | ■ | ■ | ■ | | ■ | ■ | 2 | NE 16/1 COTTON |
| PICK 19 | ■ | ■ | ■ | ■ | ■ | ■ | ■ | ■ | ■ | | ■ | ■ | 3 | NE 16/1 COTTON |
| PICK 18 | ■ | ■ | | ■ | ■ | | ■ | ■ | | ■ | ■ | | 1 | 70 DEN pes lycra |
| PICK 17 | ■ | ■ | | ■ | ■ | ■ | ■ | ■ | ■ | ■ | ■ | ■ | 2 | NE 16/1 COTTON |
| PICK 16 | ■ | ■ | | ■ | ■ | ■ | ■ | ■ | ■ | ■ | ■ | ■ | 3 | NE 16/1 COTTON |
| PICK 15 | ■ | | ■ | ■ | | ■ | ■ | | ■ | ■ | | ■ | 1 | 70 DEN pes lycra |
| PICK 14 | ■ | ■ | ■ | ■ | ■ | ■ | ■ | | ■ | ■ | ■ | ■ | 2 | NE 16/1 COTTON |
| PICK 13 | ■ | ■ | ■ | ■ | ■ | ■ | ■ | | ■ | ■ | ■ | ■ | 3 | NE 16/1 COTTON |
| PICK 12 | | ■ | ■ | | ■ | ■ | | ■ | ■ | | ■ | ■ | 1 | 70 DEN pes lycra |
| PICK 11 | | ■ | ■ | ■ | ■ | ■ | ■ | ■ | ■ | ■ | ■ | ■ | 2 | NE 16/1 COTTON |
| PICK 10 | | ■ | ■ | ■ | ■ | ■ | ■ | ■ | ■ | ■ | ■ | ■ | 3 | NE 16/1 COTTON |
| PICK 9 | ■ | ■ | | ■ | ■ | | ■ | ■ | | ■ | ■ | | 1 | 70 DEN pes lycra |
| PICK 8 | ■ | ■ | ■ | ■ | ■ | | ■ | ■ | ■ | ■ | ■ | ■ | 2 | NE 16/1 COTTON |
| PICK 7 | ■ | ■ | ■ | ■ | ■ | | ■ | ■ | ■ | ■ | ■ | ■ | 3 | NE 16/1 COTTON |
| PICK 6 | ■ | | ■ | ■ | | ■ | ■ | | ■ | ■ | | ■ | 1 | 70 DEN pes lycra |
| PICK 5 | ■ | ■ | ■ | ■ | ■ | ■ | ■ | ■ | ■ | ■ | | ■ | 2 | NE 50/1 COTTON |
| PICK 4 | ■ | ■ | ■ | ■ | ■ | ■ | ■ | ■ | ■ | ■ | | ■ | 3 | NE 50/1 COTTON |
| PICK 3 | | ■ | ■ | | ■ | ■ | | ■ | ■ | | ■ | ■ | 1 | 70 DEN pes lycra |
| PICK 2 | ■ | ■ | ■ | | ■ | ■ | ■ | ■ | ■ | ■ | ■ | ■ | 2 | NE 16/1 COTTON |
| PICK 1 | ■ | ■ | ■ | | ■ | ■ | ■ | ■ | ■ | ■ | ■ | ■ | 3 | NE 16/1 COTTON |
| | W1 | W2 | W3 | W4 | W5 | W6 | W7 | W8 | W9 | W10 | W11 | W12 | | |

METHOD OF MAKING WOVEN FABRIC THAT PERFORMS LIKE A KNITTED FABRIC

This application claims priority from Provisional Application Ser. No. 61/308,724, filed Feb. 26, 2010, the entire disclosure is incorporated herein by reference.

BACKGROUND

1. Field of the Invention

Articles and methods consistent with the present invention relate to woven textiles.

2. Description of Related Art

Woven fabrics and knitted fabrics, as a general rule, have very different qualities. Woven fabrics such as denim gabardine, poplin, and others tend to be stable, but more rigid than knitted fabrics, and therefore do not drape well over a figure. Knitted fabrics are flexible, stretch in both the vertical and horizontal direction even if inelastic yarns are used, and drape well over the body.

Denim, an indigo dyed woven fabric, has enjoyed popularity in the fashion industry at least partly due to the ring dyeing process used in creating the indigo yarns. In general, indigo dye is located close to the surface of the yarns, leaving the core of the yarn undyed. Because the dye is located at the surface of the yarns, denim fabrics fade differently than fabrics made from non-ring dyed yarns. Additionally, different finishing techniques can be applied to denim to take advantage of these ring dyed yarns. For example, denim can be hand scraped, sand blasted, stone washed, or treated in other ways that allow varying amounts of the undyed cores of the indigo yarns to become visible. The effects created through these treatments have made denim a popular and fashionable fabric in the clothing and textile industries.

Due to denim's woven nature, it has rarely been used for tops, such as shirts, blouses and sweatshirts. On the other hand, knit indigo fabrics have failed to become popular due the expense necessary to create them. For example, to create a knit fabric, the yarns used must be wound on a bobbin. This is an expensive, additional step needed to create knitted indigo fabrics. Some have attempted to dye fabrics with indigo after knitting has taken place, but this too comes with problems. Dyeing after knitting is difficult to control due to the elastic nature of the fabric. Furthermore, both sides of the fabric end up dyed with indigo which can lead to staining if the person wearing the fabric sweats. Still others have tried dying the knitting yarns with indigo while on the bobbin, but this too gives unsatisfactory results.

SUMMARY

An exemplary embodiment of the invention is to provide an article that looks, feels, and performs like a knitted fabric, but is created through weaving. Another exemplary embodiment of the invention is to provide a method for making such an article.

In accordance with an exemplary embodiment of the present invention, there is provided an article comprising a fabric having a front side and a back side and including a plurality of warp yarns and a plurality of weft yarns woven together in a pattern, wherein the weft yarns include hard yarns and elastomeric yarns arranged in a predetermined arrangement comprising at least one hard yarn alternately arranged with at least one elastomeric yarn, the elastomeric yarns having a greater shrinkage ratio than the shrinkage ratio of the hard yarns, wherein the hard yarns form alternately arranged under portions and over portions with respect to said warp yarns, said under portions being formed when said hard yarns pass along the back side of the warp yarns and defining loop portions, and said over portions being formed when the hard yarns pass along the front side of the warp yarns and define connection portions, wherein for each hard yarn, an average number of warp yarns passed by the loop portion is at least 6, and wherein the elastomeric yarns form alternately arranged under portions and over portions with respect to said warp yarns in a weave that is tighter than the weave of the hard yarns.

It should be noted that while this disclosure uses the terms "elastomeric" and "hard" to describe yarns, for the purposes of this disclosure "elastomeric" simply means that the yarns have a greater shrinkage ratio than the "hard" yarns. It could very well be the case that both the "elastomeric" and "hard" weft yarns are elastic, or neither of the "elastomeric" or "hard" weft yarns are elastic.

In accordance with an exemplary embodiment of the present invention, after the weaving, but before a shrinking, the predetermined arrangement comprises a warp density between approximately 20 and 70 warps/cm, inclusive.

According to another exemplary embodiment of the present invention after three home washes the predetermined arrangement comprises a warp density between approximately 25 and 80 warps/cm.

In yet another exemplary embodiment of the present invention, after the weaving, but before a shrinking the predetermined arrangement comprises a weft density between 20 and 70 weft/cm, inclusive.

In still another exemplary embodiment of the present invention, after three home washes the predetermined arrangement comprises a weft density between approximately 25 and 80 weft/cm, inclusive.

In a further exemplary embodiment of the present invention, the warp yarns have an English cotton number between approximately Ne 10 and Ne 40, inclusive.

Similarly, in another exemplary embodiment of the present invention, the elastomeric yarns have a denier between approximately 40 and 140 denier, inclusive.

In still another exemplary embodiment of the present invention, the hard yarns have an English cotton number between approximately Ne 10 and Ne 60, inclusive.

In still yet another exemplary embodiment of the present invention, the warp yarns are ring-dyed indigo yarns.

In accordance with another exemplary embodiment of the invention, what is provided is an article comprising a fabric having a first weave and a second weave; wherein the first weave forms a front face of the fabric, the first weave substantially comprising warp yarns and elastomeric weft yarns tightly woven in a predetermined pattern, wherein the second weave forms a back face of the fabric, the second weave substantially comprising said warp yarns and hard weft yarns loosely woven in a predetermined pattern such that said hard weft yarns form alternately arranged under portions and over portions with respect to said warp yarns, said under portions being formed when said hard weft yarns pass along the back side of the warp yarns and defining loop portions and said over portions being formed when said hard weft yarn passes along the front side of the warp yarns and defining connection portions, wherein for each hard weft yarn, an average number of warp yarns passed by the loop portion is at least 6, wherein the elastomeric weft yarns form alternately arranged under portions and over portions with respect to said warp yarns in a weave that is tighter than the weave of the hard yarns, and wherein said elastomeric and hard weft yarns are arranged in a predetermined arrangement comprising at least one hard yarn alternately arranged with at least one elastomeric yarn, the elastomeric yarns having a greater shrinkage ratio than the shrinkage ratio of the hard yarns.

According to another exemplary embodiment of the invention, a method is provided for creating a fabric, the method comprising providing warp yarns; providing hard weft yarns; providing elastomeric weft yarns, the elastomeric weft yarns having a greater shrinkage ratio than the shrinkage ratio of the hard weft yarns; selecting a weave pattern wherein at least one hard yarn is alternately arranged with at least one elastomeric yarn, the hard yarns pass alternately along the back side of the warp yarns a predetermined number of warp yarns for each pass to form a series of hard under portions, and along the front side of the warp yarns a predetermined number of warp yarns for each pass to form hard over portions, and for each hard yarn, an average number of warp yarns passed by each under portion is at least 6, and the elastomeric yarns pass alternately along the back side of the warp yarns a predetermined number of warp yarns for each pass to form a series of elastomeric under portions, and along the front side of the warp yarns a predetermined number of warp yarns for each pass to form a series of elastomeric over portions; weaving the fabric according to the selected pattern; shrinking the woven fabric wherein the elastomeric weft yarns shrink more than the hard weft yarns causing the hard under portions to form loop portions.

BRIEF DESCRIPTION OF THE DRAWINGS

The above and/or other aspects will become apparent and more readily appreciated from the following description of the exemplary embodiments, taken in conjunction with the accompanying drawings, in which are depicted:

FIG. 5—A weave report for an exemplary embodiment as described in Example 1 below.

FIG. 6—A weave report for an exemplary embodiment as described in Example 2 below.

FIG. 9—A weave report for an exemplary embodiment as described in Example 5 below.

FIG. 11—A weave report for an exemplary embodiment as described in Example 7 below.

FIG. 13—A weave report for an exemplary embodiment as described in Example 9 below.

FIG. 14—A weave report for an exemplary embodiment as described in Example 10 below.

DETAILED DESCRIPTION OF EXEMPLARY EMBODIMENTS

Figure 1:
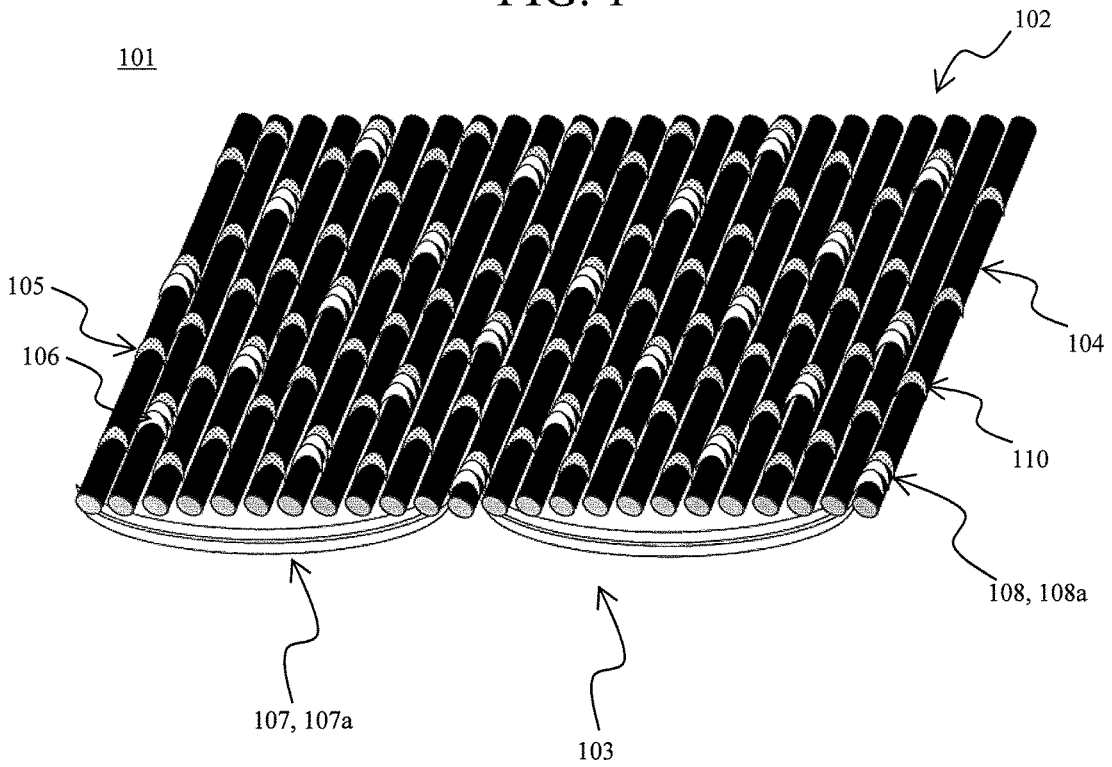
FIG. 1—A fabric according to an exemplary embodiment.

Below, exemplary embodiments will be described in detail with reference to accompanying drawings so as to be readily understood by a person of ordinary skill in the art. The inventive concept may be embodied in various forms without being limited to the exemplary embodiments set forth herein. Descriptions of well-known parts are omitted for clarity, and like reference numerals refer to like elements throughout.

An article according to a first exemplary embodiment is shown in FIG. 1. Illustrated is a woven fabric 101 having a front side 102 and a backside 103. The fabric 101 is woven together from warp yarns 104 and weft yarns 105, 106. According to the preferred embodiment, the warp yarns are indigo dyed.

According to the exemplary embodiment, the weft yarns comprise elastomeric yarns 105 and hard yarns 106. In this exemplary embodiment the elastomeric yarns 105 have a greater shrinkage ratio than the hard yarns 106. The elastomeric yarns 105 and hard yarns 106 are arranged in a predetermined arrangement comprising at least one hard yarn 106 alternately arranged with at least one elastomeric yarn 105. According to the exemplary embodiment illustrated in FIG. 1, there is a single elastomeric yarn 105 arranged between two hard yarns 106, but the yarns could be arranged differently without deviating from the inventive concept. For example, in preferred embodiments, the average ratio of elastomeric yarns 105 to hard yarns 106 is between 2:1 and 1:5, inclusive. It is more preferred that the average ratio of elastomeric yarns 105 to hard yarns 106 is between 1:2 and 1:3, inclusive. Furthermore, the ratio of elastomeric yarns 105 to hard yarns 106 need not be regular, or the same throughout the fabric.

The weave of the fabric is such that the hard yarns form alternately arranged under portions 107 and over portions 108 with respect to the to the warp yarns 104. The under portions 107 are formed when the hard yarns pass along the backside of the warp yarns and defining loop portions 107*a*. The over portions are formed when the hard yarns pass along the front side of the warp yarns 104 and define connections portions 108*a*.

For each hard yarn 106, the average number of warp yarns 104 passed by each loop portion 107*a* is at least 6. The number of warp yarns 104 passed by each loop portions 107*a* need not be the same for all loop portions 107*a*, nor is it necessary that every loop portion 107*a* pass at least 6 warp yarns 104. So long as for each hard yarn 106 the average number of warp yarns 104 passed by each loop is at least 6, the number of warp yarns 104 passed by individual loop portions 107*a* can vary without deviating from the inventive concept, as would be known to one skilled in the art.

While FIG. 1 illustrates the loop portions 107*a* passing eleven warp yarns 104 compared to the one warp yarn 104 passed by each connection portion 108*a*, in other exemplary embodiments the ratio of warp yarns 104 passed by loop portions 107*a* to warp yarns 104 passed by connection portions 108*a* is between approximately 3:1 and 24:1, inclusive.

Figure 2:
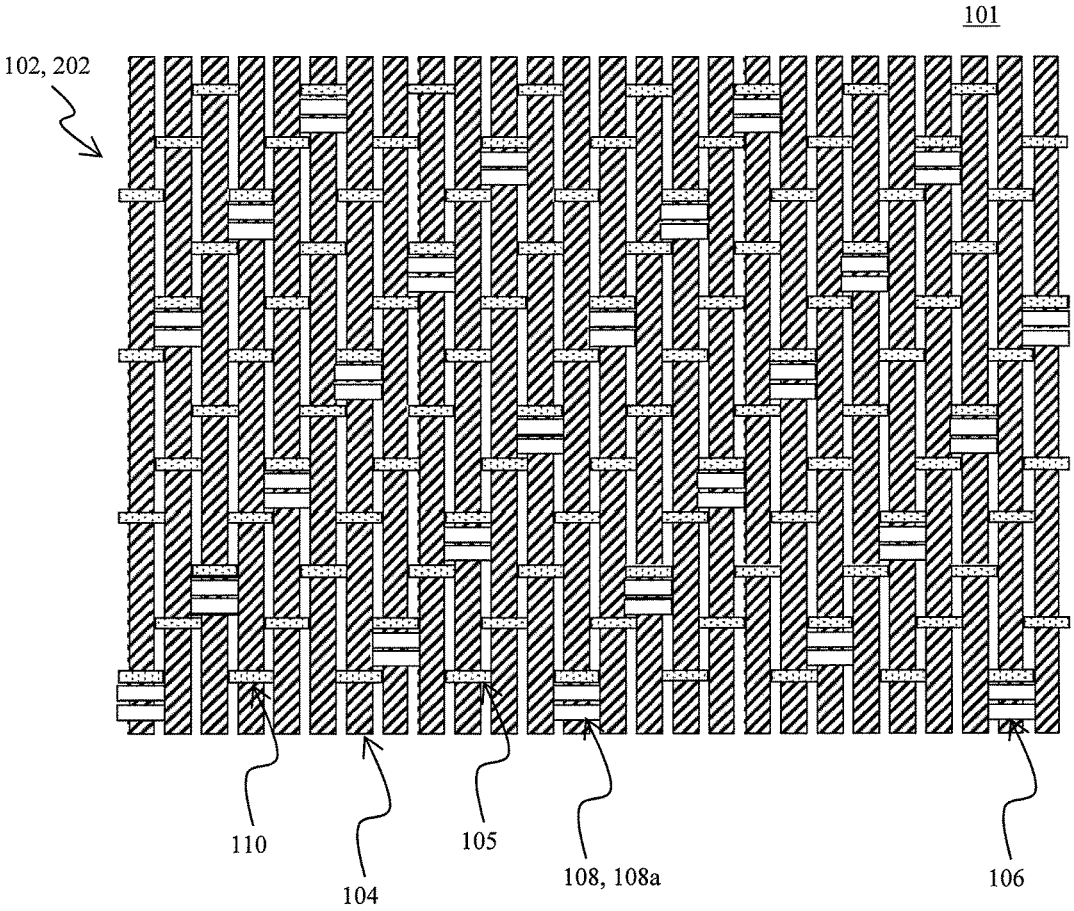
FIG. 2—A front face of a fabric according to an exemplary embodiment.
Figure 3:
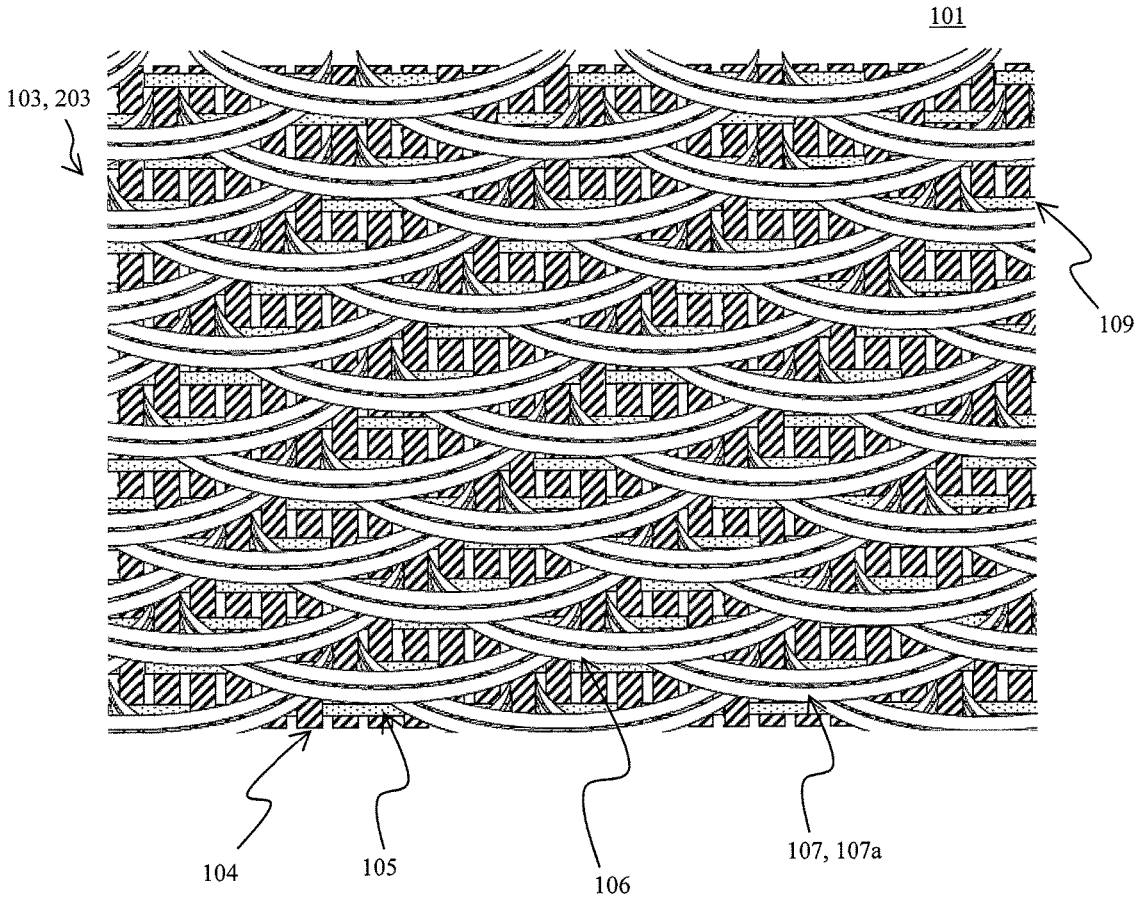
FIG. 3—A back face of a fabric according to an exemplary embodiment.

The elastomeric yarns form alternately arranged under portions 109 and over portions 110 with respect to said warp yarns 104 in the weave. These under portions 109 and over portions 110 form a weave with respect to the warp yarns 104 that is tighter than the weave formed by the hard yarns 106. While the weave pattern illustrated in FIGS. 1-3 shows over portions 110 passing one warp yarn 104 and under portion 109 passing two warp yarns 104, the number of warp yarns 104 passed by the over portions 110 and under portions 109 can vary without deviating from the inventive concept.

According to exemplary embodiments, the loop portions 107*a* of the hard yarns are created such that they are in substantially less tension than under portions 109 and over portions 110 created by the elastomeric weft yarns 105. It can also be the case that the loop portions 107*a* are in at least one of equilibrium or compression.

The loop portions 107*a* help to add to the knit-like appearance and behavior of the woven fabric. For example, loose loops 107*a* can hang loosely at the back of the fabric such that they are droopy. The droopy nature of the loop portions 107*a* gives the fabric a softer feel, much like that of a knitted fabric.

Also, because knitted fabrics are created by connecting yarn loops together, the loop portions 107*a* give the back of the fabric the appearance of a knitted fabric. In addition, because of their length and droopiness, the loop portions 107*a* are able to cover a substantially larger portion of the back of the fabric than if they were tightly woven against the warp yarns. This allows the loop portions 107*a* to substantially hide the sometimes uncomfortable under portions 109. When the loop portions 107*a* are made from soft cotton yarns, as would often be the case, they provide a soft, comfortable backside to the fabric.

An additional benefit of the droopy loop portions 107*a* is helping to prevent the warp yarns 104 from contacting the skin. This benefit is of particular importance to denim fabrics made from indigo dyed yarns. If these warps yarns 106 are indigo dyed and are allowed to come in contact with the wearer's skin, they can stain the skin when the wearer sweats.

As seen in FIGS. 1 and 3, the loop portions 107*a* form a pattern extending in a diagonal direction with respect to the warp yarns 104 and weft yarns 105, 106. Similarly, the connection portions 108*a* form a pattern extending in a diagonal direction with respect to the warp yarns 104 and weft yarns 105, 106. As seen in FIG. 1, the weave pattern of the hard yarns can be different than the weave pattern of the elastomeric yarns. For example, the weave pattern chosen for the hard yarns could be a twill pattern, with some other type of pattern chosen for the elastomeric yarns.

In exemplary embodiments, the weave pattern and/or yarn selection allows the fabric 101 to stretch in a diagonal direction with respect to the warp yarns 104 and weft yarns 105, 106.

By using diagonal patterns, multiple benefits can be achieved. First, when the warp yarns 104 are indigo dyed, the use of a diagonal pattern can give the fabric the look of a classic denim weave, while maintaining all the benefits of the feel and behavior of a knitted fabric. The diagonal patterns also allow the fabric to stretch in the diagonal direction, further adding to the knit-like behavior of the fabric.

In exemplary embodiments, the preferred warp density after weaving but before shrinking is between approximately 20 and 70 warp yarns per centimeter, inclusive. After treatment of the fabric and after three home washes, the preferred warp density is between approximately 25 and 80 warp yarns per centimeter, inclusive. It is even more preferred that the warp density after weaving but before shrinking be between approximately 25 and 60 warp yarns per centimeter, inclusive, and between approximately 30 and 65 warp yarns per centimeter after three home washes. Even more preferably, the warp density would be between approximately 30 and 50 warp yarns per centimeter, inclusive, after weaving but before shrinking, and between approximately 35 and 55 warp yarns per centimeter after three home washes. Generally, the warp and weft density measurements are made at 65% humidity, ±5%, and 20° C., ±2° C.

Similar to the warp density, exemplary embodiments can also define weft densities. It is preferred that after weaving, but before shrinking, the weft density be between approximately 30 and 90 weft yarns per centimeter, inclusive. After three home washes it is preferred that the weft density be between approximately 35 and 95 wefts per centimeter, inclusive. In preferred embodiments, it is more preferred that after weaving, but before shrinking, the weft density be between approximately 40 and 80 wefts per centimeter, inclusive. After three home washings, it is more preferred that the weft density be between approximately 45 and 85 wefts per centimeter, inclusive. It is even more preferred that after weaving but before shrinking, the weft density be between 50 and 70 wefts per centimeter, inclusive, and between approximately 55 and 75 wefts per centimeter, inclusive, after three home washes.

The selection of the warp and weft densities not only adds to the knit-like behavior of the fabric, but it also allows, in conjunction with the selection of appropriate yarns, for the creation of fabrics having different weights. For example, the weight can be chosen to be similar to that of a t-shirt, or alternatively, similar to that of sweatpants.

In exemplary embodiments, the ratio of the average number of warp yarns passed by the loop portions to a warp density is between approximately 0.2 and 0.7, inclusive.

In other exemplary embodiments, the ratio of the average number of warp yarns passed by the loop portions to the average number of warp yarns passed by the connection portions is between approximately 6 and 24, inclusive.

Another aspect of exemplary embodiments is the thickness of the yarns used for the warp and weft yarns. Because the elastomeric yarns will often be synthetic, they will be described herein using denier (den.), while the warp yarns and hard weft yarns will be described using English cotton yarn number (Ne). Not withstanding the numbering system used to described the yarns, a person of ordinary skill in the art will know how to convert from one system to the other, and would understand that the numbering system used in no way limits the properties and compositions of the yarns used.

Though not drawn to scale, it is illustrated in FIG. 1 that the warp, hard and elastomeric fibers can have different thicknesses, and it may be preferable that the elastomeric fibers have a smaller thickness than the hard fibers. In exemplary embodiments, it is preferred that the warp yarns are between approximately Ne 10 and Ne 40, inclusive. It is more preferred that the warp yarns are between approximately Ne 15 and Ne 25, inclusive. In exemplary embodiments it is preferred that the hard yarns are between approximately Ne 10 and Ne 70, inclusive. It is more preferred that the hard yarns be between approximately Ne 15 and Ne 50, inclusive. In exemplary embodiments it is preferred that the elastomeric yarns be between approximately 40 den. and 140 den., inclusive. It is more preferred that the elastomeric yarns be between approximately 60 den. and 80 den., inclusive.

By selecting the relative thicknesses of the of the yarns within the values of the inventive concept multiple benefits are achieved. For example, when the thickness of the hard weft yarns 106 is larger than that of the elastomeric weft yarns 105, the thicker loop portions 107*a* are better able to hide the under portions 109 from being seen and felt at the back of the fabric. The selection of correct yarn thicknesses also add to the knit-like feel and weight of the fabric.

FIGS. 2 and 3 show another way of looking at exemplary embodiments of the inventive concept. The fabric of exemplary embodiments can be thought of as a fabric 101 having a first weave 202 (shown in FIG. 2) and a second weave 203 (shown in FIG. 3). First weave 202 generally forms a front face of the fabric 102 and substantially comprises warp yarns 104 and elastomeric weft yarns 105 tightly woven in a predetermined arrangement. The second weave 203 generally forms a back face of the fabric 103 and substantially comprises warp yarns 104 and hard weft yarns 106 loosely woven in a predetermined arrangement such that the hard weft yarns 106 form alternately arranged under portions 107 and over portions 108 with respect to the warp yarns 104. The under portions 107 are formed when the hard weft yarns 106 pass along the backside 103 of the warp yarns 104 thereby defining loop portions 107*a*. The over portions 108 are formed when the hard weft yarns pass along the front side of the warp yarns 104, defining connection portions 108*a*. As depicted in FIG. 3, the number of warp yarns 104 passed by each loop portion 107*a* is 11, but in other exemplary embodiments the number may be different.

In FIG. 2, the first weave 202 is formed from elastomeric weft yarns 105 arranged in a predetermined arrangement with respect to the warp yarns 104 forming over portions 110 and under portions 109 in a weave that is tighter than the second weave 203.

In exemplary embodiments the second weave 203 substantially prevents the warp yarns 104 passed over by the elastomeric fibers 105 of the first weave 202 from being felt or seen from the back side 103 of the fabric 101.

Figure 4:
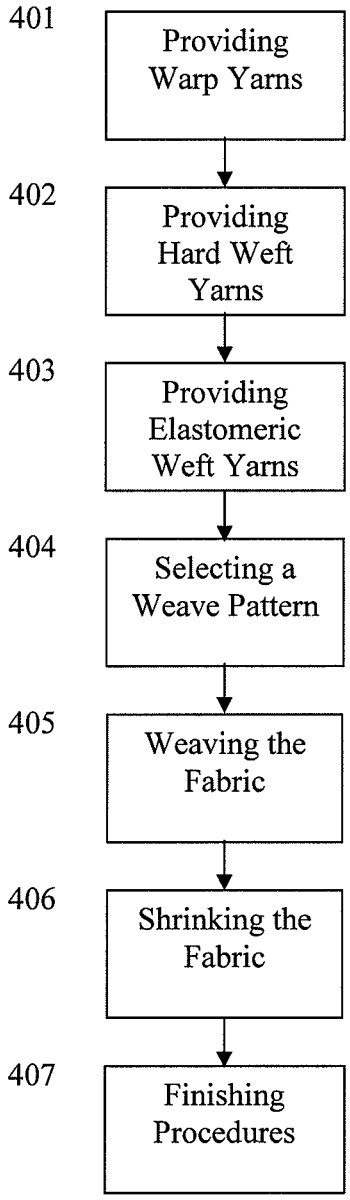
FIG. 4—A functional representation of a method of making a fabric according to an exemplary embodiment.

FIG. 4 represents a method of making a fabric according to an exemplary embodiment of the inventive concept. As illustrated in functional block 401, the first step of the process is providing warp yarns. The step can include selecting a thickness of the yarns, as well as determining the warp density. Determining other aspects of the warp yarns, known to those skilled in the art, can also be determined at this step. It will often be the case that this step will include the selection of indigo dyed warp yarns. The use of indigo dyed warp yarns will allow the resulting fabric to take advantage of many of the unique aspects of the indigo dyeing process. These aspects include, but are not limited to, the unique weathering effects that can be achieved with the ring dyed indigo yarns.

Functional block 402 is a step in which hard weft yarns are provided. Similar to step 401, this step can include determining all the aspects of the hard weft yarns known to those skilled in the art, including but not limited to: the thickness of the yarns, shrinkage ratio, elasticity, color, weft density, etc. Functional block 403 represents a similar step with regards to the elastomeric weft yarns. In this step, all aspects of the elastomeric weft yarns can be selected.

Functional block 404 represents the step of determining a weave pattern. In this step, any weave pattern known to those skilled in the art can be selected, so long as at least one hard yarn is alternately arranged with at least one elastomeric yarn; ensuring the hard yarns pass alternately along the back side of the warp yarns in a predetermined number of warp yarns for each pass to form a series of over portions and under portions, and along the front side of the warp yarns a predetermined number of warp yarns for each pass to form hard over portions; the average number of warp yarns passed by each under portion is at least six; and the elastomeric yarns pass alternately along the back side of the warp yarns a predetermined number of warp yarns for each pass to form a series of elastomeric under portions, and along the front side of the warp yarns a predetermined number of warp yarns for each pass to form a series of elastomeric over portions.

Functional block 405 represents weaving the warp and weft yarns according to the selected weave pattern.

Functional block 406 represents the step of shrinking the fabric after weaving. During this shrinking the elastomeric yarns will shrink more than the hard yarns causing the under portions to become loop portions.

In exemplary embodiments, the loops portions are in substantially less tension than the over portions and under portions formed by the elastomeric yarns. In other exemplary embodiments the loops portions are in at least one of equilibrium and compression.

Other exemplary embodiments can add additional finishing procedures 407 to the process of creating the fabric. These steps can include applying weathering effects to the finished fabric such as bleaching, hand scraping, sand blasting, stone washing and others known to those skilled in the art. These steps can include brushing either one of the front or back side of the fabric. The process can also include printing letters or graphics onto the fabric, or embroidering patterns and logos onto the fabric. The fabric can even be ripped and torn to meet the demands of current fashion trends. The process can also include tailoring the fabric into garments, or other steps known to those skilled in the art.

What follows next are very specific examples of exemplary embodiments according to the inventive concept. The inventive concept is capable of other and different embodiments without deviating from the scope and spirit of the inventive concept. The examples should be considered illustrative in nature and not as restrictive.

EXAMPLE 1

The result of this exemplary embodiment is a knitted fabric having the weight and feel of a knitted t-shirt, but doing so with indigo dyed yarns which will allow for the application of abrasion effects previously only available at great cost. The warp yarns, weft yarns, warp density, weft density and loom set-up were chosen according to the values in Table 1. These selections gave the resulting fabric a weight of approximately 5-7 oz/sqyd. The weave pattern was selected according to the weave report depicted in FIG. 5. A dobby-type weaving loom with a weft selection system was used to perform the weaving.

TABLE 1

| Sample | Warp Yarn | Elastomeric Weft Yarn | Hard Weft Yarn | Warp Density | Weft Density | Fabric Weight | Warps passed by "Loop" Portion |
|---|---|---|---|---|---|---|---|
| Example 1 | Ne 20/1 Ring spun 100% cotton, | 70 Denier polyester + 40 Denier | Ne 50/1 Combed 100% cotton Yarn | 27 ends/cm in weaving reed | 54 picks/cm in loom state fabric, | 5-7 oz/sqyd | 11 |

TABLE 1-continued

| Sample | Warp Yarn | Elastomeric Weft Yarn | Hard Weft Yarn | Warp Density | Weft Density | Fabric Weight | Warps passed by "Loop" Portion |
|---|---|---|---|---|---|---|---|
| | indigo dyed yarn | Lycra (with 3:5 draft ratio) interminled yam | | | 61.5 picks/cm finished fabric | | |
| Example 2 | Ne 20/1 Ring spun 100% cotton yarn | 70 Denier Polyester + 40 Denier Lycra (with 3.5 draft ratio) interminled yam | Yarn 2:Ne 50/1 Combed 100% cotton yarn | 27 ends/cm in weaving reed | 54 pick/cm in loom state fabric 61.5 picks/cm when fabric finished | 5-7 oz/sqyd | 11 |
| Example 3 | Ne 20/1 Ring spun 100% cotton yarn | 70 Denier Polyester + 40 Denier Lycra (with 3.5 draft ratio) interminled yarn | Ne 50/1 Combed 100% cotton yarn | 27 ends/cm in weaving reed | 54 pick/cm in loom state fabric 61.5 picks/cm when fabric finished | 5-7 oz/sqyd | 11 |
| Example 4 | Ne 20/1 Ring spun 100% cotton yarn | 70 Denier Polyester + 40 Denier Lycra (with 3.5 draft ratio) interminled yarn | Ne 50/1 Combed 100% cotton yarn | 27 ends/cm in weaving reed | 54 pick/cm in loom state fabric 61.5 picks/cm when fabric finished | 5-7 oz/sqyd | 11 |
| Example 5 | Ne 20/1 Ring spun 100% cotton yarn | 70 Denier Polyester + 40 Denier Lycra (with 3.5 draft ratio) interminled yarn | Ne 50/1 Combed 100% cotton yarn | 27 ends/cm in weaving reed | 54 pick/cm in loom state fabric 61.5 picks/cm when fabric finished | 5-7 oz/sqyd | 11 |
| Example 6 | Ne 20/1 Ring spun 100% cotton yarn | 70 Denier Polyester + 40 Denier Lycra (with 3.5 draft ratio) interminled yarn | Ne 50/1 Combed 100% cotton yarn | 27 ends/cm in weaving reed | 54 pick/cm in loom state fabric 61.5 picks/cm when fabric finished | 5-7 oz/sqyd | 11 |
| Example 7 | Ne 20/1 Ring spun 100% cotton yarn | 70 Denier 100% Nylon yarn | Ne 50/1 Combed 100% cotton yarn | 27 ends/cm in weaving reed | 54 pick/cm in loom state fabric 61.5 picks/cm when fabric finished | 5-7 oz/sqyd | 11 |
| Example 8 | Ne 20/1 Ring spun | 70 Denier Polyester | Ne 50/1 Combed 100% | 27 ends/cm in | 54 pick/cm in loom | 5-7 oz/sqyd | 20 |

TABLE 1-continued

| Sample | Warp Yarn | Elastomeric Weft Yarn | Hard Weft Yarn | Warp Density | Weft Density | Fabric Weight | Warps passed by "Loop" Portion |
|---|---|---|---|---|---|---|---|
| | 100% cotton yarn | + 40 Denier Lycra (with 3.5 draft ratio) interming led yarn | cotton yarn | weaving reed | state fabric 61.5 picks/cm when fabric finished | | |
| Example 9 | Ne 20/1 Ring spun 100% cotton yarn | Denier Polyester + 40 Denier Lycra (with 3.5 draft ratio) interming led yarn | 150 Denier 100% micro Polyester yarn | 27 ends/cm in weaving reed | 42.2 pick/cm in loom state fabric 48.2 picks/cm when fabric finished | 8 oz/sqyd | 11 |
| Example 10 | Ne 20/1 Ring spun 100% cotton yarn | Denier Polyester + 40 Denier Lycra (with 3.5 draft ratio) interming led yarn | Ne 16/1 ring 100% cotton yarn | 27 ends/cm in weaving reed | 42.2 pick/cm in loom state fabric 48.2 picks/cm when fabric finished | ~10 oz/sqyd | 11 |

After weaving, the fabric was wetted and stretched in the length (warp) direction. When this happens, the fabric shrinks in the width (weft) direction, the Lycra™ (elastane) yarn pulling the warn yarns together. Because the cotton weft yarns contain no elastane, they do not shrink as much as the Lycra™ yarns, and the cotton yarn floats on the back of the fabric formed long loops which cover most of the back side of the fabric. After shrinking, the fabric was heat set to reduce shrinking in further garment washings.

The resulting fabric had the weight and feel of a knitted fabric, including the much softer feel generally associated with knitted fabrics. At the same time, the indigo warp yarns gave the warp side fabric the look and qualities of a denim fabric, such as denim's ability to take on finishing effects, such as abrasion effects. The back side of the fabric was white in color due to the un-dyed weft yarns, and was extremely soft due to the long loops created thereon. A person wearing a garment made from the fabric is prevented from feeling the uncomfortable polyester weft yarns by the long loops that dominate the back side of the fabric. The long loops also prevent the indigo from coming into contact with the skin of a person wearing the garment, preventing the indigo dye from running if the person sweats.

Due at least in part to the selection of the weave and elastomeric weft yarns, the resulting fabric had very high elastic properties. These properties included the ability to stretch in all directions, not just the weft direction.

EXAMPLE 2

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 6. Examination of the weave report shows that the ratio of elastomeric yarns to hard yarns is 2:1, as opposed to 1:2 in Example 1.

EXAMPLE 3

Figure 7:
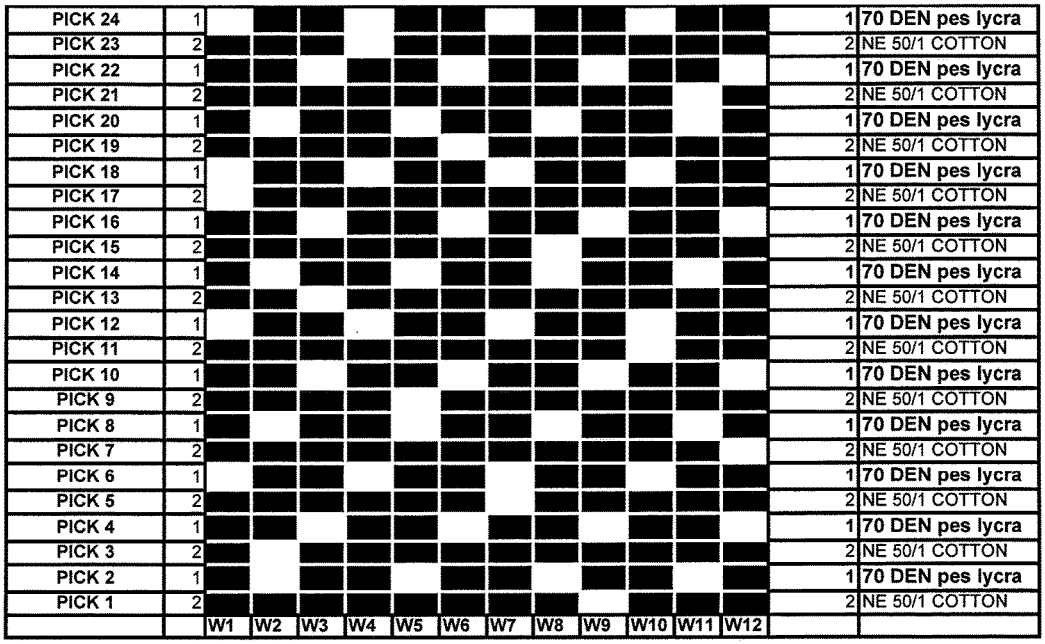
FIG. 7—A weave report for an exemplary embodiment as described in Example 3 below.

The result of this example is a knitted fabric having the weight and feel of a knitted fabric. The warp yarns, well yarns, warp density, weft density and loom set-up were chosen according to the values in Table 1. The weave pattern was selected according to the weave report depicted in FIG. 7. Examination of the weave report shows that the ratio of elastomeric yarns to hard yarns is 1:1, as opposed to 1:2 in Example 1.

EXAMPLE 4

Figure 8:
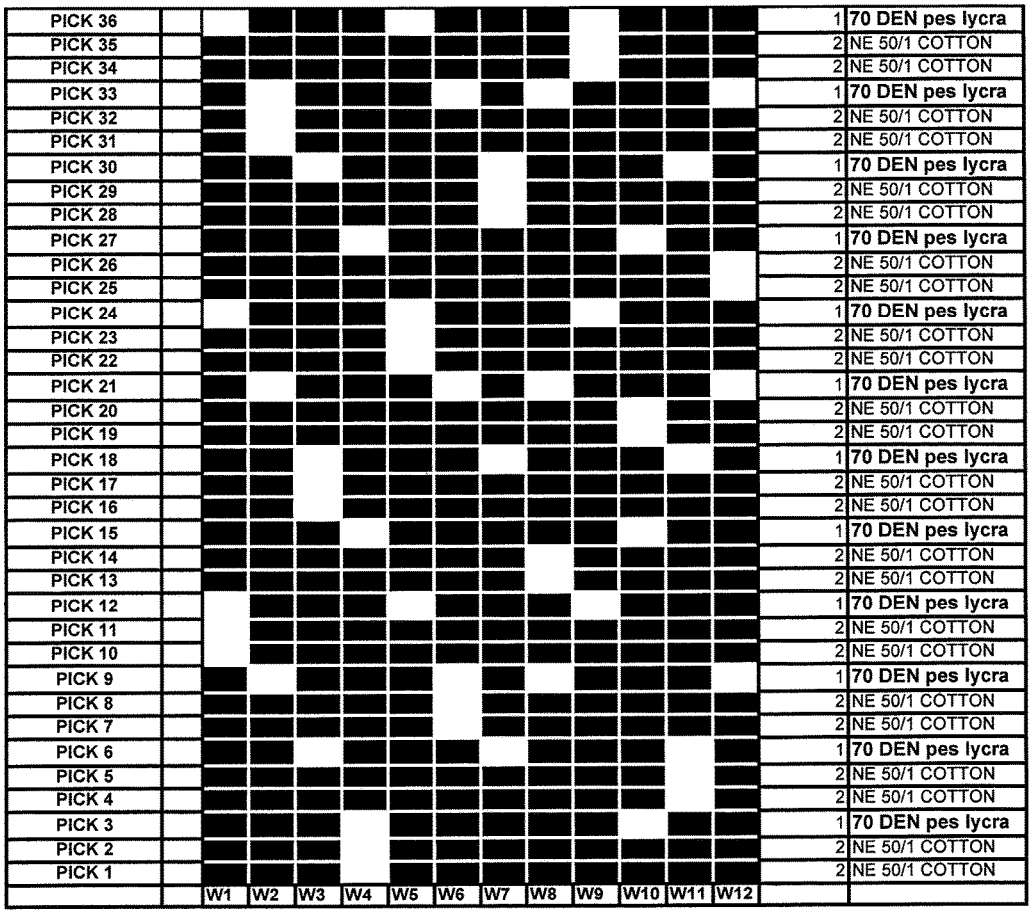
FIG. 8—A weave report for an exemplary embodiment as described in Example 4 below.

The result of this example is a knitted fabric having the weight and feel of a knitted fabric. The warp yarns, well yarns, warp density, well density and loom set-up were chosen according to the values in Table 1. The weave pattern was selected according to the weave report depicted in FIG. 8. As can be seen in the weave report, the weave on the front side of the fabric is herring bone, and the number of warps passed by the elastomeric weft yarns need not be the same throughout the weave. For example, the number of warp yarns passed by the well yarn at pick 27 is different than the numbers passed by the weft yarn at pick 21.

EXAMPLE 5

The result of this example is a knitted fabric having the weight and feel of a knitted fabric. The warp yarns, well yarns, warp density, well density and loom set-up were chosen according to the values in Table 1. The weave pattern was selected according to the weave report depicted in FIG. 9. This example makes use another exemplary embodiment of a weave pattern.

EXAMPLE 6

Figure 10:
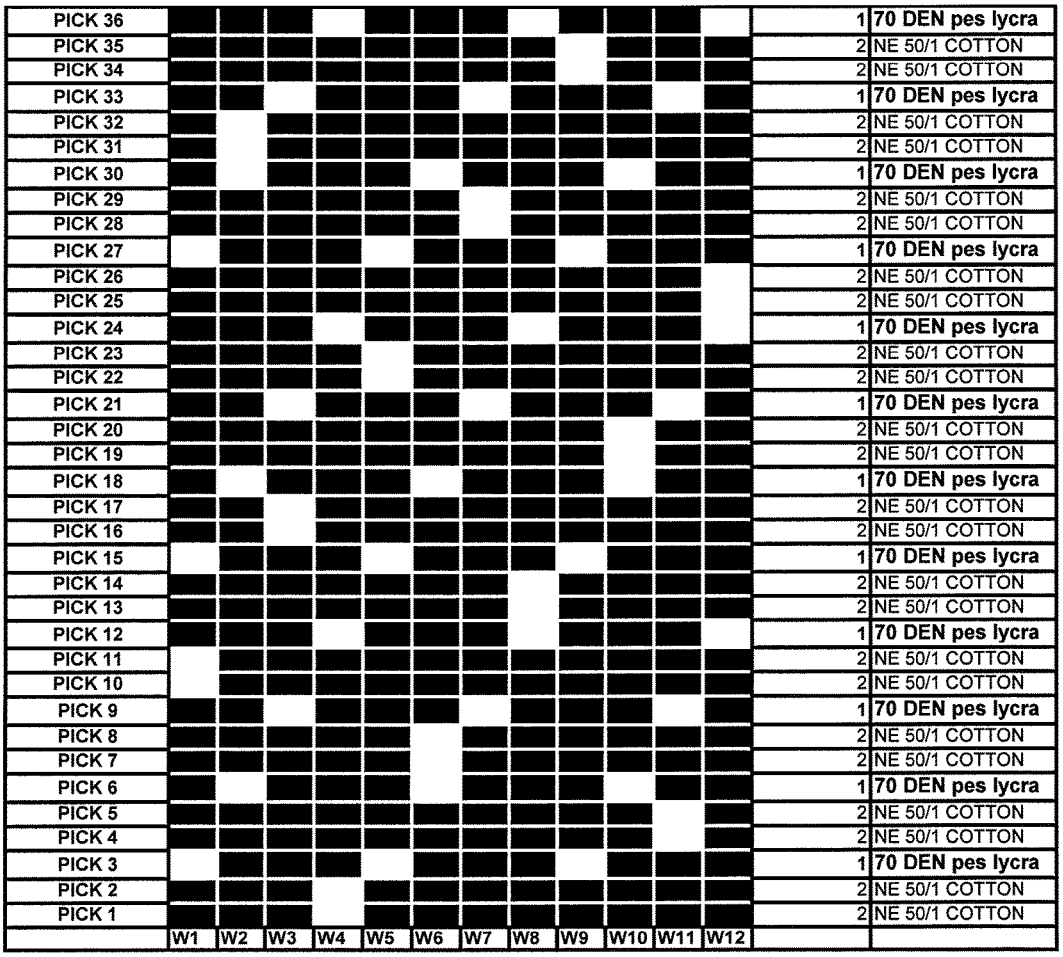
FIG. 10—A weave report for an exemplary embodiment as described in Example 6 below.

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 10. This example makes use another exemplary embodiment of a weave pattern.

EXAMPLE 7

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 11. As can be seen the values depicted in Table 1, this example makes use of synthetic weft yarns that do not include Lycra.

EXAMPLE 8

Figure 12:
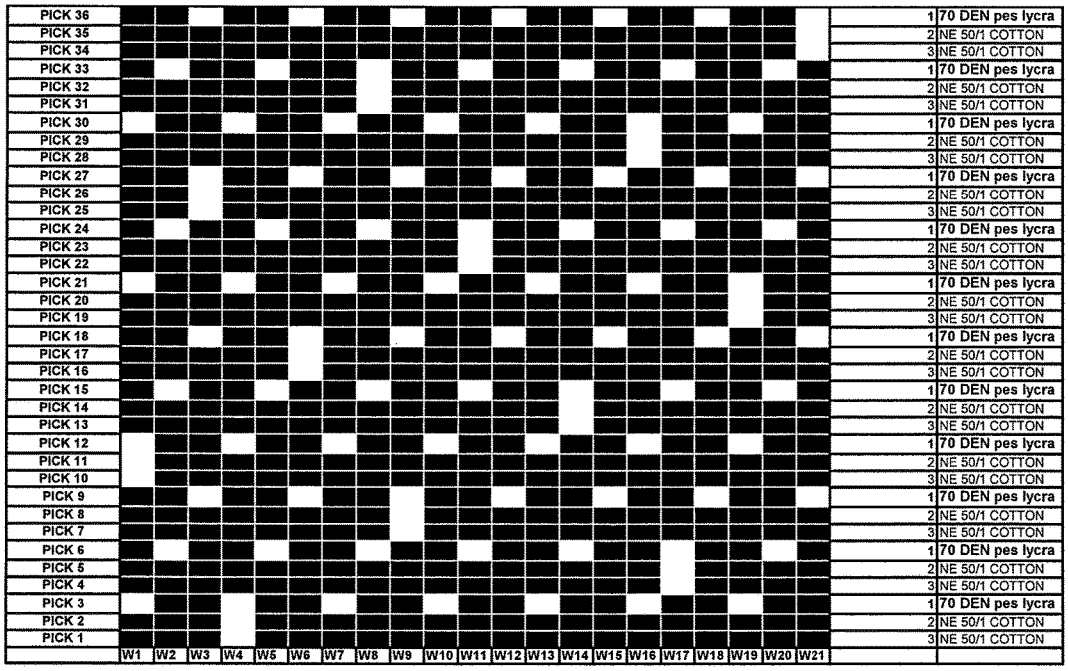
FIG. 12—A weave report for an exemplary embodiment as described in Example 8 below.
Figure 15:
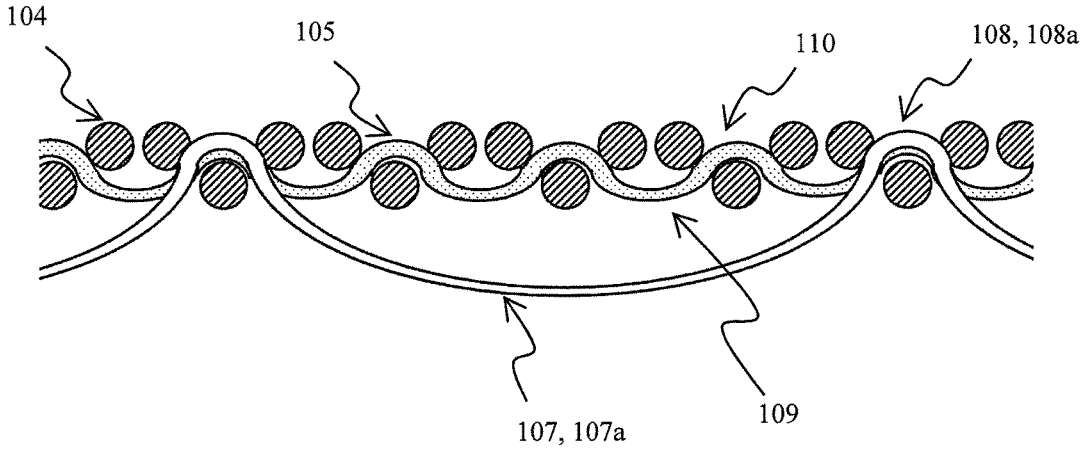
FIG. 15—A cross-sectional view of a fabric of an exemplary embodiment.

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 12. As can be seen in the weave pattern of FIG. 12, the under portions of the hard weft yarns pass 20 warp yarns.

EXAMPLE 9

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 13. As can be seen in Table 1, the hard weft yarn of this example is a polyester yarn. As a result of these polyester yarns, the resulting fabric has a higher weight than the previous example. Embodiments such as Example 9, as well as the other examples, can include brushing the back side of the fabric.

EXAMPLE 10

The result of this example is a knitted fabric having the weight and feel of a knitted fabric. The warp yarns, weft yarns, warp density, weft density and loom set-up were chosen according to the values in Table 1. The weave pattern was selected according to the weave report depicted in FIG. 14. As can be seem in Table 1, a heavier cotton hard weft yarn is used, resulting in the heavier fabric weight of this example.

What is claimed is:

1. An article, comprising:

a fabric having a first weave and a second weave;

wherein the first weave forms a front face of the fabric, the first weave comprising warp yarns and elastomeric weft yarns tightly woven in a predetermined pattern, wherein the second weave forms a back face of the fabric, the second weave comprising said warp yarns and hard weft yarns loosely woven in a predetermined pattern comprising at least one said hard weft yarn alternately arranged with at least one said elastomeric weft yarn, the elastomeric weft yarns having a greater shrinkage ratio than the hard weft yarns whereby the elastomeric weft yarns are capable of shrinking to a greater degree than the hard weft yarns, wherein the hard weft yarns form alternately arranged under portions and over portions with respect to said warp yarns, said under portions being formed when said hard weft yarns pass along the back side of the warp yarns and defining loop portions, and said over portions being formed when said hard weft yarns pass along the front side of the warp yarns and defining connection portions, wherein said connection portions are exposed to the front face of the fabric, wherein for each hard weft yarn, an average number of warp yarns passed by the loop portions is at least 6, wherein the elastomeric weft yarns form alternately arranged under portions and over portions with respect to said warp yarns in a weave that is tighter than a weave of the hard yarns;

wherein the loop portions defined by the hard weft yarns are located only on the back face of the fabric and are continuously curved in shape;

wherein the fabric is elastic;

the elastomeric yarns include elastane and are elastic, the hard yarns are inelastic, the warp yarns are each formed of cotton and do not criss-cross one another, and the connection portions of the hard weft yarns form a pattern extending in a diagonal direction with respect to the warp yarns and the weft yarns.

2. The article according to claim 1, wherein the average number of warp yarns passed by the loop portion is at least 3 times an average number of warp yarns passed by the connection portions.

3. The article according to claim 1, wherein the loop portions are looser than the over and under portions formed by the elastomeric yarns.

4. The article according to claim 1, wherein the loop portions of adjacent hard yarns form a pattern extending in a diagonal direction with respect to the warp yarns and the weft yarns.

5. The article of claim 1, wherein the fabric stretches in a diagonal direction with respect to the warp yarns and weft yarns.

6. The article of claim 1, wherein the weave pattern of the hard yarns is different from the weave pattern of the elastomeric yarns.

7. The article of claim 1, wherein the weave pattern of the elastomeric yarns is a twill pattern.

8. The article of claim 1, wherein after weaving, but before shrinking the predetermined arrangement comprises a warp density between approximately 20 and 70 warps/cm, inclusive.

9. The article of claim 1, wherein after three home washes the predetermined arrangement comprises a warp density between approximately 25 and 80 warps/cm.

10. The article of claim 1, wherein after weaving, but before shrinking the predetermined arrangement comprises a warp density between approximately 25 and 60 warps/cm.

11. The article of claim 1, wherein after three home washes the predetermined arrangement comprises a warp density between approximately 30 and 65 warps/cm, inclusive.

12. The article of claim 1, wherein after weaving, but before shrinking the predetermined arrangement comprises a warp density between approximately 30 and 50 warps/cm.

13. The article of claim 1, wherein after three home washes the predetermined arrangement comprises a warp density between approximately 35 and 55 warps/cm, inclusive.

14. The article of claim 1, wherein after weaving, but before shrinking the predetermined arrangement comprises a weft density between 30 and 90 wefts/cm, inclusive.

15. The article of claim 1, wherein after three home washes the predetermined arrangement comprises a weft density between approximately 35 and 95 wefts/cm, inclusive.

16. The article of claim 1, wherein after weaving, but before shrinking the predetermined arrangement comprises a weft density between approximately 40 and 80 wefts/cm, inclusive.

17. The article of claim 1, wherein after three home washes the predetermined arrangement comprises a weft density between approximately 45 and 85wefts/cm, inclusive.

18. The article of claim 1, wherein after weaving, but before shrinking the predetermined arrangement comprises a weft density between approximately 50 and 70 wefts/cm.

19. The article of claim 1, wherein after three home washes the predetermined arrangement comprises a weft density between approximately 55 and 75 wefts/cm, inclusive.

20. An article, comprising:

a fabric having a first weave and a second weave;

wherein the first weave forms a front face of the fabric, the first weave comprising warp yarns and elastomeric weft yarns tightly woven in a predetermined pattern, wherein the second weave forms a back face of the fabric, the second weave comprising said wrap yarns and hard weft yarns loosely woven in a predetermined pattern such that at least one said hard weft yarn is alternately arranged with at least one said elastomeric weft yarn, the elastomeric weft yarns having a greater shrinkage ratio than the hard weft yarns whereby the elastomeric weft yarns are capable of shrinking to a greater degree than the hard weft yarns, wherein the hard weft yarns form alternately arranged under portions and over portions with respect to said warp yarns, said under portions being formed when said hard weft yarns pass along the back side of the warp yarns and defining loop portions, and said over portions being formed when said hard weft yarns pass along the front side of the warp yarns and defining connection portions, wherein said connection portions are exposed on the front face of the fabric, wherein for each hard weft yarn, an average number of warp yarns passed by the loop portions is at least 6, wherein the elastomeric weft yarns form alternately arranged under portions and over portions with respect to said warp yarns in a weave that is tighter than a weave of the hard yarns, wherein the loop portions defined by the hard weft yarns are located only on the back face of the fabric and are continuously curved in shape, wherein the fabric is elastic, the elastomeric yarns include elastane and are elastic;

and wherein the warp yarns have an English cotton number between approximately Ne 10 and Ne 30, inclusive, the hard weft yarns have an English cotton number between approximately Ne 10 and Ne 70, inclusive, and, after three home washes, the pre-determined arrangement has a weft density between, 30 and 85 wefts/cm, inclusive, and a warp density between approximately 25 and 80 warps/cm, and wherein a ratio of elastomeric yarns to hard yarns is between approximately 1:2 and 1:3, inclusive and the connection portions of the hard weft yarns form a pattern extending in a diagonal direction with respect to the warp yarns and the weft yarns.

21. The article of claim 1, wherein the warp yarns are 100% cotton.

22. The article of claim 1, wherein the hard yarns have an English cotton number between approximately Ne 10 and Ne 70, inclusive.

23. The article of claim 1, wherein the hard yarns have an English cotton number between approximately Ne 15 and Ne 50, inclusive.

24. The article of claim 1, wherein the elastomeric yarns have a denier between approximately 40 and 140 denier, inclusive.

25. The article of claim 1, wherein the elastomeric yarns have a denier between approximately 50 and 90 denier, inclusive.

26. The article of claim 1, wherein the warp yarns are ring-dyed indigo yarns.

27. The article of claim 1, wherein a ratio of warps passed by the loop portion to the connection portion is between approximately 3:1 and 24:1, inclusive.

28. The article of claim 1, wherein a ratio of elastomeric yarns to hard yarns is between approximately 2:1 and 1:5, inclusive.

29. The article of claim 1, wherein a ratio of elastomeric yarns to hard yarns is between approximately 1:2 and 1:3, inclusive.

30. The article of claim 1, wherein the loop portions are disposed over the elastomeric under portions, wherein the elastomeric yarns have a denier between approximately 40 and 140 denier, inclusive.

31. The article of claim 1, wherein a ratio of the average number of warp yarns passed by the loop portions to a warp density is between approximately 0.2 and 0.7, inclusive.

32. The article of claim 1, wherein the average number of warp yarns passed by the loop portions is between 6 and 24, inclusive.

33. An article comprising:

a fabric having a first weave and a second weave;

wherein the first weave forms a front face of the fabric, the first weave comprising warp yarns and elastomeric weft yarns tightly woven in a predetermined pattern, wherein the second weave forms a back face of the fabric, the second weave comprising said warp yarns and hard weft yarns loosely woven in a predetermined pattern such that said hard weft yarns form alternately arranged under portions and over portions with respect to said warp yarns, said under portions being formed when said hard weft yarns pass along a back side of the warp yarns and defining loop portions, and said over portions being formed when said hard weft yarn passes along the front side of the warp yarns and define connection portions, wherein said connection portions are exposed on the front side of the fabric, wherein for each hard weft yarn, an average number of warp yarns passed by the loop portion is at least 6, wherein the elastomeric weft yarns form alternately arranged under portions and over portions with respect to said warp yarns in a weave that is tighter than the weave of the hard yarns, and wherein said elastomeric and hard weft yarns are arranged in a predetermined arrangement comprising at least one hard yarn alternately arranged with at least one elastomeric yarn, the elastomeric yarns having a greater shrinkage ratio than the hard yarns whereby the elastomeric yarns are capable of shrinking to a greater degree than the hard yarns;

wherein the loop portions defined by the hard yarns are located only on the back face of the fabric and are continuously curved in shape;

wherein the fabric is elastic; and wherein the elastomeric weft yarns include elastane, are elastic, and have a denier between approximately 50 and 90 denier, inclusive, and wherein the hard yarns are inelastic, and after three home washes the predetermined arrangement has a weft density between approximately 55 and 75 wefts/cm, inclusive.

34. The article of claim 33, wherein the warp yarns are covered by the elastomeric yarns of the first weave.

35. The article of claim 33, wherein on the back face of the fabric the second weave covers the warp and elastomeric weft yarns of the first weave.

36. A woven fabric, comprising:

a first weave forming a rear face of the woven fabric, the first weave comprising warp yarns and hard weft yarns loosely woven in a predetermined pattern, a second weave forming a front face of the woven fabric, the second weave comprising said warp yarns and elastic weft yarns tightly woven in a predetermined pattern, the weft yarns extending over selected warp yarns to provide over portions on the front face, and further extending on an opposed back face of the fabric between two adjacent over portions to define under portions of the weft yarns, wherein the hard weft yarns have a first shrinkage ratio and said elastic weft yarns have a second shrinkage ratio, wherein the elastic weft yarns are capable of shrinking to a greater degree than the hard weft yarns, the hard and elastic weft yarns being alternated to provide a fabric pattern, wherein the under portions of the plurality of hard weft yarns form loops that are continuously curved in shape, extend past at least 6 warp yarns and form a gap between each of said loops and said rear face and wherein the under portion of the elastic weft yarns extend for an amount of warp yarns that is less than 6 to provide a tighter weave of the elastic weft yarns with respect to the hard weft yarns, wherein the woven fabric is elastic, and wherein the elastic weft yarns include elastane, the hard weft yarns are inelastic, a thickness of the hard weft yarns is larger than a thickness of the elastic weft yarns and the front face has a scraped appearance whereby the warp yarns do not criss-cross one another, are inelastic and indigo-dyed and undyed cores of the indigo-dyed warp yarns are visible on said front face, and wherein connection portions of the hard weft yarns form a pattern on said front face extending in a diagonal direction with respect to the warp yarns and the weft yarns.

37. The article according to claim 1, wherein a thickness of the hard yarns is larger than a thickness of the elastomeric yarns.

38. The article according to claim 1, wherein the front side includes an abraded appearance.

39. The article of claim 33, wherein the warp yarns are indigo-dyed and undyed cores of the indigo-dyed warp yarns are visible on said front face.

40. The article of claim 1, wherein the loop portions and the back side include a gap therebetween.

41. The article of claim 33, wherein the loop portions and the back face include a gap therebetween.

42. The article according to claim 38, wherein the warp yarns are indigo-dyed and undyed cores of the indigo-dyed warp yarns are visible on said front side to form said abraded appearance.

* * * * *